US008066158B2

(12) United States Patent
Vogel et al.

(10) Patent No.: US 8,066,158 B2
(45) Date of Patent: Nov. 29, 2011

(54) CLOSURE FOR A CONTAINER

(75) Inventors: William C. Vogel, Mequon, WI (US); Terrence M. Parve, Menomonee Falls, WI (US)

(73) Assignee: Gateway Plastics, Inc., Mequon, WI (US)

( * ) Notice: Subject to any disclaimer, the term of this patent is extended or adjusted under 35 U.S.C. 154(b) by 867 days.

(21) Appl. No.: 11/661,880

(22) PCT Filed: Sep. 3, 2005

(86) PCT No.: PCT/US2005/031562
§ 371 (c)(1),
(2), (4) Date: May 15, 2008

(87) PCT Pub. No.: WO2006/029092
PCT Pub. Date: Mar. 16, 2006

(65) Prior Publication Data

US 2008/0257918 A1 Oct. 23, 2008

Related U.S. Application Data

(60) Provisional application No. 60/607,787, filed on Sep. 5, 2004.

(51) Int. Cl.
*B67D 3/00* (2006.01)

(52) U.S. Cl. ..... 222/480; 222/556; 222/565; 220/254.2; 220/287; 220/366.1; 220/367.1; 220/837; 215/235; 215/319

(58) Field of Classification Search ..... 222/556, 222/565, 480–481.5, 517, 545–546, 498; 220/259.3, 254.1, 837, 254.2, 287, 254.3, 220/254.5, 254.7, 256.1, 259.1, 259.2, 366.1, 220/367.1; 215/235, 237, 343–344, 346, 215/319

See application file for complete search history.

(56) References Cited

U.S. PATENT DOCUMENTS

| | | | |
|---|---|---|---|
| 181,615 | A | 8/1876 | Albertson |
| 199,896 | A | 2/1878 | Burger |
| 847,726 | A | 3/1907 | Brannon |

(Continued)

OTHER PUBLICATIONS

Graphic Images: Closure #1, 1 page.

(Continued)

*Primary Examiner* — Frederick C. Nicolas
(74) *Attorney, Agent, or Firm* — Foley & Lardner LLP

(57) ABSTRACT

A closure for a container is disclosed having a body portion, a top portion, and a plurality of sealing rings. The body portion has an open bottom formed of a skirt and an end wall defining an opening. The top portion has a flap that is movable from a closed position where the opening is covered to an open position where the opening is at least partially uncovered to allow for matter to be dispensed. The plurality of sealing rings are within the skirt beneath the end wall and comprise (1) a first ring with a sealing surface provided a first radial distance from the skirt and a first axial distance from the end wall and (2) a second ring with a sealing surface provided a second radial distance from the skirt and a second axial distance from the end wall. The first radial distance is different than the second radial distance and the first axial distance is different than the second axial distance. The sealing surface of the first ring is configured to fit over a mouth of a receptacle having a first diameter and the planar sealing surface of the second ring is configured to fit over a mouth of a receptacle having a second diameter.

19 Claims, 16 Drawing Sheets

U.S. PATENT DOCUMENTS

| | | | | | |
|---|---|---|---|---|---|
| 893,469 | A | * | 7/1908 | Essmuller | 215/319 |
| 947,025 | A | | 1/1910 | Pearl et al. | |
| 1,330,365 | A | | 2/1920 | Alexander | |
| 1,773,553 | A | | 8/1930 | Taylor et al. | |
| 2,108,063 | A | | 2/1938 | Hothersall | |
| D110,872 | S | | 8/1938 | Lewis | |
| 2,177,589 | A | | 10/1939 | Jacker | |
| 2,562,647 | A | | 7/1951 | Shaver | |
| 2,576,416 | A | | 11/1951 | Randlett | |
| 2,636,636 | A | * | 4/1953 | Smith | 220/369 |
| 2,690,861 | A | | 10/1954 | Tupper | |
| 2,760,672 | A | * | 8/1956 | Cronheim | 220/287 |
| 2,894,654 | A | | 7/1959 | Lohrer | |
| 3,018,931 | A | | 1/1962 | Westgate | |
| 3,100,589 | A | | 8/1963 | Love, Jr. | |
| 3,113,693 | A | | 12/1963 | Stull | |
| 3,140,019 | A | | 7/1964 | Barr | |
| 3,155,285 | A | | 11/1964 | Van Baarn | |
| 3,180,537 | A | | 4/1965 | Collins | |
| 3,262,606 | A | | 7/1966 | Waterman | |
| 3,322,308 | A | | 5/1967 | Foster | |
| 3,323,671 | A | | 6/1967 | Minarik, Jr. et al. | |
| 3,372,832 | A | | 3/1968 | Yeater et al. | |
| 3,486,665 | A | | 12/1969 | La Croce | |
| D218,289 | S | | 8/1970 | Posada | |
| 3,542,235 | A | | 11/1970 | Hidding | |
| 3,606,074 | A | * | 9/1971 | Hayes | 220/212 |
| 3,741,377 | A | | 6/1973 | Krellen | |
| 3,807,457 | A | * | 4/1974 | Logsdon | 138/89 |
| D245,750 | S | | 9/1977 | Maclean | |
| 4,082,201 | A | | 4/1978 | Bittel | |
| 4,106,672 | A | | 8/1978 | Tecco et al. | |
| 4,120,432 | A | | 10/1978 | Fuchs | |
| 4,170,315 | A | | 10/1979 | Dubach et al. | |
| 4,198,040 | A | * | 4/1980 | Colasent | 220/254.4 |
| D255,326 | S | | 6/1980 | Pettengill | |
| 4,253,587 | A | | 3/1981 | Otterson | |
| 4,274,563 | A | | 6/1981 | Otterson | |
| 4,280,636 | A | | 7/1981 | Lewis | |
| 4,284,200 | A | | 8/1981 | Bush et al. | |
| 4,291,818 | A | | 9/1981 | Nozawa et al. | |
| 4,346,823 | A | | 8/1982 | Eppenbach | |
| D266,390 | S | | 10/1982 | Haner | |
| 4,359,171 | A | | 11/1982 | Lewis | |
| 4,361,250 | A | | 11/1982 | Foster | |
| 4,369,901 | A | | 1/1983 | Hidding | |
| 4,463,869 | A | | 8/1984 | Lewis | |
| 4,494,679 | A | | 1/1985 | Cleevely | |
| 4,538,731 | A | | 9/1985 | Cillario | |
| 4,545,495 | A | | 10/1985 | Kinsley | |
| 4,545,508 | A | | 10/1985 | Cribb, Jr. et al. | |
| 4,580,687 | A | | 4/1986 | Lewis | |
| 4,610,371 | A | | 9/1986 | Karkiewicz | |
| 4,611,725 | A | | 9/1986 | Kacalieff | |
| 4,621,744 | A | | 11/1986 | Foster | |
| 4,648,528 | A | | 3/1987 | LaBarge et al. | |
| 4,651,885 | A | | 3/1987 | Gach | |
| 4,658,980 | A | | 4/1987 | Lindstrom | |
| 4,693,399 | A | | 9/1987 | Hickman et al. | |
| 4,714,181 | A | | 12/1987 | Kozlowski et al. | |
| 4,723,693 | A | | 2/1988 | DeCoster | |
| 4,739,906 | A | | 4/1988 | LoTurco | |
| 4,792,054 | A | | 12/1988 | Weidman | |
| 4,793,501 | A | | 12/1988 | Beck | |
| 4,793,502 | A | | 12/1988 | Beck | |
| 4,823,995 | A | | 4/1989 | Lewis | |
| 4,848,612 | A | | 7/1989 | Beck | |
| 4,881,668 | A | | 11/1989 | Kitterman et al. | |
| D305,206 | S | | 12/1989 | Hickman et al. | |
| 4,898,292 | A | | 2/1990 | VerWeyst et al. | |
| D306,563 | S | | 3/1990 | Johnson | |
| D306,701 | S | | 3/1990 | Beck | |
| 4,927,065 | A | | 5/1990 | Beck | |
| 4,936,494 | A | | 6/1990 | Weidman | |
| 4,940,167 | A | | 7/1990 | Fillmore et al. | |
| 4,955,513 | A | | 9/1990 | Bennett | |
| 4,967,941 | A | | 11/1990 | Beck | |
| 4,984,716 | A | | 1/1991 | Beck | |
| 4,989,748 | A | * | 2/1991 | Parr et al. | 220/368 |
| 4,993,606 | A | | 2/1991 | Bolen, Jr. et al. | |
| 5,007,555 | A | | 4/1991 | Beck | |
| 5,016,787 | A | | 5/1991 | Beck | |
| D318,778 | S | | 8/1991 | Fiore et al. | |
| D319,588 | S | | 9/1991 | Beck | |
| 5,048,730 | A | | 9/1991 | Forsyth et al. | |
| D320,739 | S | | 10/1991 | Camus | |
| 5,052,572 | A | | 10/1991 | Pherigo | |
| D321,476 | S | | 11/1991 | Alcover | |
| D323,461 | S | | 1/1992 | Beck | |
| D323,462 | S | | 1/1992 | Beck | |
| D324,175 | S | | 2/1992 | Beck | |
| 5,085,331 | A | | 2/1992 | Groya et al. | |
| 5,129,531 | A | | 7/1992 | Beck et al. | |
| 5,139,181 | A | | 8/1992 | VerWeyst | |
| 5,167,338 | A | | 12/1992 | Kick | |
| 5,197,634 | A | | 3/1993 | Beck | |
| 5,211,301 | A | | 5/1993 | Groya et al. | |
| 5,215,204 | A | | 6/1993 | Beck et al. | |
| 5,219,100 | A | | 6/1993 | Beck et al. | |
| D339,065 | S | | 9/1993 | Forsyth et al. | |
| D340,187 | S | | 10/1993 | Forsyth | |
| 5,282,540 | A | | 2/1994 | Beck | |
| 5,297,688 | A | | 3/1994 | Beck et al. | |
| 5,305,931 | A | | 4/1994 | Martin et al. | |
| D346,958 | S | | 5/1994 | Olson | |
| D347,974 | S | | 6/1994 | McBride | |
| 5,328,063 | A | | 7/1994 | Beck et al. | |
| 5,330,082 | A | | 7/1994 | Forsyth | |
| 5,339,993 | A | | 8/1994 | Groya et al. | |
| 5,467,879 | A | | 11/1995 | Moore | |
| 5,494,200 | A | | 2/1996 | Sheffler et al. | |
| 5,507,419 | A | | 4/1996 | Martin et al. | |
| 5,509,582 | A | | 4/1996 | Robbins, III | |
| 5,511,679 | A | | 4/1996 | Beck | |
| 5,542,579 | A | | 8/1996 | Robbins, III | |
| 5,566,850 | A | | 10/1996 | Forsyth et al. | |
| 5,601,213 | A | | 2/1997 | Daniello | |
| 5,667,089 | A | | 9/1997 | Moore | |
| 5,680,968 | A | | 10/1997 | Moore | |
| D385,791 | S | | 11/1997 | Forsyth et al. | |
| 5,743,444 | A | | 4/1998 | Beck et al. | |
| 5,829,609 | A | | 11/1998 | Beck | |
| 5,829,611 | A | | 11/1998 | Beck | |
| 5,842,592 | A | | 12/1998 | Beck | |
| 5,875,907 | A | | 3/1999 | Lay | |
| 5,971,231 | A | | 10/1999 | Samz et al. | |
| 5,975,368 | A | | 11/1999 | Wood | |
| 5,996,859 | A | | 12/1999 | Beck | |
| D419,069 | S | | 1/2000 | Beck et al. | |
| 6,024,256 | A | | 2/2000 | Beck et al. | |
| 6,089,519 | A | * | 7/2000 | Laybourne | 248/346.11 |
| 6,095,354 | A | | 8/2000 | Herr et al. | |
| 6,102,257 | A | | 8/2000 | Goyet | |
| 6,116,477 | A | | 9/2000 | Kreiseder et al. | |
| 6,158,632 | A | | 12/2000 | Ekkert | |
| 6,164,503 | A | | 12/2000 | Forsyth et al. | |
| 6,170,664 | B1 | | 1/2001 | Dar | |
| D440,156 | S | | 4/2001 | Lonczak et al. | |
| 6,250,517 | B1 | | 6/2001 | Samz et al. | |
| 6,283,317 | B1 | | 9/2001 | Benoit gonin et al. | |
| 6,289,906 | B1 | | 9/2001 | Vanden Dries et al. | |
| 6,299,033 | B1 | | 10/2001 | VerWeyst et al. | |
| 6,308,870 | B2 | | 10/2001 | Samz et al. | |
| 6,321,923 | B1 | | 11/2001 | Wood | |
| 6,325,231 | B1 | | 12/2001 | Ketting et al. | |
| 6,332,551 | B1 | | 12/2001 | Copeland | |
| RE37,634 | E | | 4/2002 | Hickman et al. | |
| 6,382,476 | B1 | | 5/2002 | Randall et al. | |
| 6,405,885 | B1 | | 6/2002 | Elliott | |
| 6,439,410 | B1 | | 8/2002 | Dubach | |
| 6,460,712 | B2 | | 10/2002 | Smith et al. | |
| 6,460,718 | B1 | | 10/2002 | Vogel | |
| 6,460,726 | B1 | | 10/2002 | Hierzer et al. | |
| 6,464,113 | B1 | | 10/2002 | Vogel | |
| 6,474,491 | B1 | | 11/2002 | Benoit-Gonin et al. | |
| 6,477,743 | B1 | | 11/2002 | Gross et al. | |
| 6,481,589 | B2 | | 11/2002 | Blomdahl et al. | |

| | | | |
|---|---|---|---|
| 6,488,187 | B2 | 12/2002 | Sheffler et al. |
| 6,494,346 | B2 | 12/2002 | Gross et al. |
| 6,508,373 | B1 | 1/2003 | Robinson |
| 6,510,971 | B1 | 1/2003 | Martin |

OTHER PUBLICATIONS

Graphic Images: Closure #2, 1 page.
Graphic Images: Closure #3, 1 page.
Graphic Images: Closure #4, 1 page.
Graphic Images: Closure #5, 1 page.
Graphic Images: Closure #6, 1 page.
Graphic Images: Closure #7, 1 page.
Graphic Images: Closure #8, 1 page.
Graphic Images: Closure #9, 1 page.
Graphic Images: Closure #10, 1 page.
Graphic Images: Closure #11, 2 pages.
Graphic Images: Closure #12, 1 page.
Graphic Images: Closure #13, 2 pages.
International Search Report for PCT/US05/31562, date of mailing, Jan. 19, 2006, 1 page.
International Preliminary Report on Patentability and Written Opinion for Application No. PCT/US05/31562, mailing date Mar. 15, 2007, 6 pages.

* cited by examiner

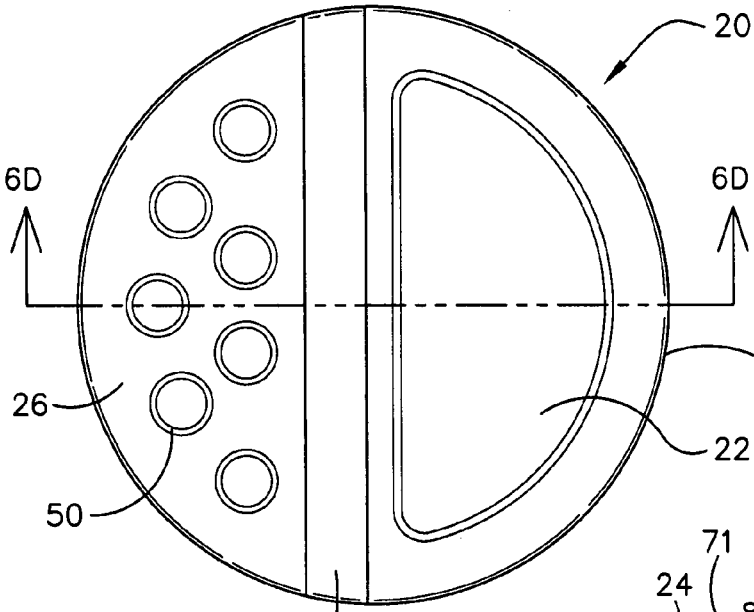
FIGURE 6A
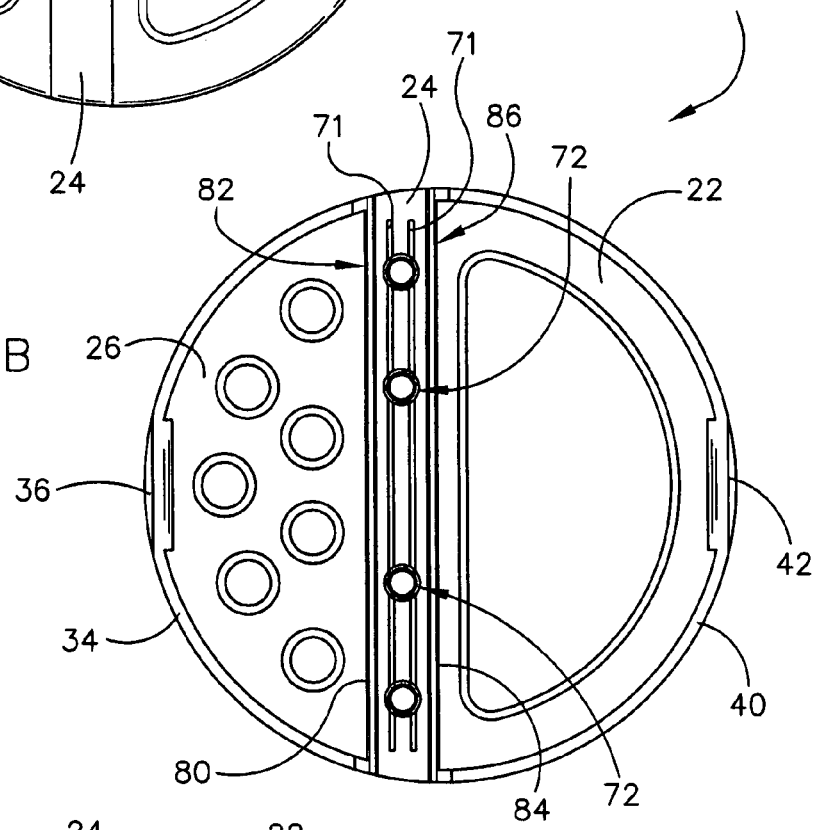
FIGURE 6B
FIGURE 6C
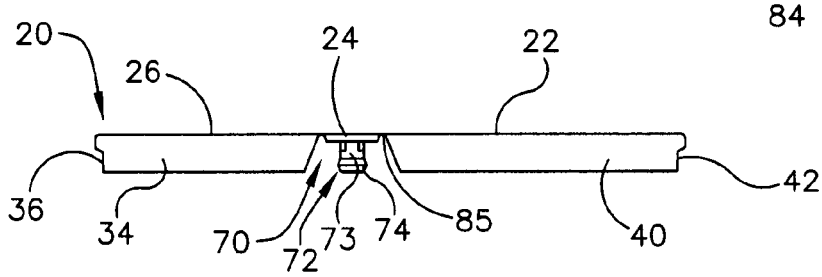

CLOSURE FOR A CONTAINER

CROSS REFERENCE TO RELATED APPLICATIONS

The present application claims priority to and the benefit of U.S. Provisional Patent Application No. 60/607,787, filed Sep. 5, 2004.

The present application is a continuation-in-part of U.S. application Ser. No. 10/435,653, filed May 9, 2003, which is a continuation of U.S. application Ser. No. 10/234,441, filed Sep. 3, 2002, now abandoned, which is a divisional of U.S. application Ser. No. 09/663,874, filed Sep. 15, 2000, now U.S. Pat. No. 6,460,718, which is a continuation-in-part of U.S. application Ser. No. 09/374,976, filed Aug. 16, 1999, now U.S. Pat. No. 6,250,517, which is a continuation of U.S. application Ser. No. 08/959,399, filed Oct. 28, 1997, now U.S. Pat. No. 5,971,231. The present application is also a continuation-in-part of U.S. application Ser. No. 29/170,146, filed Nov. 1, 2002, which is a divisional of U.S. application Ser. No. 10/234,441, filed Sep. 3, 2002, now abandoned, which is a divisional of U.S. application Ser. No. 09/663,874, filed Sep. 15, 2000, now U.S. Pat. No. 6,460,718, which is a continuation-in-part of U.S. application Ser. No. 09/374,976, filed Aug. 16, 1999, now U.S. Pat. No. 6,250,517, which is a continuation of U.S. application Ser. No. 08/959,399, filed Oct. 28, 1997, now U.S. Pat. No. 5,971,231.

The present application claims the benefit of priority as available under 35 U.S.C. §§ 119, 120, 121, and/or 365 of the following applications (which are incorporated by reference herein): U.S. Application Ser. No. 60/607,787, filed Sep. 5, 2004; U.S. application Ser. No. 29/170,146, filed Nov. 1, 2002, and U.S. application Ser. No. 10/435,653, filed May 9, 2003, both of which are continuing applications of U.S. application Ser. No. 10/234,441, filed Sep. 3, 2002, which is a divisional of U.S. application Ser. No. 09/663,874, filed Sep. 15, 2000, now U.S. Pat. No. 6,460,718, which is a continuation-in-part of U.S. application Ser. No. 09/374,976, filed Aug. 16, 1999, now U.S. Pat. No. 6,250,517, which is a continuation of U.S. application Ser. No. 08/959,399, filed Oct. 28, 1997, now U.S. Pat. No. 5,971,231.

The following patents also are hereby incorporated by reference: U.S. Pat. No. 6,464,113 titled "Container with a Threaded Cap Having a Spring-Loaded Self-Closing Cover" issued Oct. 15, 2002 and U.S. Pat. No. 6,308,870 titled "Apparatus for Covering a Container" issued Oct. 30, 2001.

FIELD

The present invention relates to a closure for a container for storing and dispensing materials. The present invention more specifically relates to a closure having one or more flaps for enclosing one or more openings in the closure.

BACKGROUND

It is generally known to provide covers or closures on plastic containers used for storing and dispensing particulate matter (e.g., granulated, powdered, etc.) or other materials, particularly foodstuffs, seasonings, etc. such as those displayed and sold in supermarkets. Such known closures typically have several openings, particularly several shaker openings, on one side of the closure and a spoon opening on an opposite side of the closure. Such known closures generally include a hinged flap for the shaker openings and a hinged flap for the spooning opening that are configured to close or seal these openings.

Such known closures may be made in a single molding operation (e.g., integrally-formed) which may require a relatively complex mold formation to obtain the desired structural features for the body, the top portion, and the flaps of the closure. Molding equipment for such single molding operations may be relatively costly to design and develop, and may require a longer molding duration, which tends to reduce the number of closures that could otherwise be produced in a given time period. Such known closures also typically include a sealing surface or ring on the inside of the closure that is configured to compress a liner or other sealing material between a mouth of the receptacle and the sealing ring to provide an air-tight seal.

Accordingly, it would be advantageous to provide a closure for a container that may be produced using a relatively simple molding operation to improve production rates. It also would be advantageous to provide a closure for a container that may be produced as two separate portions. It would be further advantageous to provide a closure for a container having two portions that may be easily coupled together. It would be further advantageous to provide a closure for a container that has a closure structure or system for holding the flaps closed. It also would be advantageous to provide a closure for a container that minimizes "sifting" or other leakage of the contents of the container from the closure when the flaps are in a closed position. It would be further advantageous to provide a closure for a container that reduces the possibility of moisture contaminating the contents of the container.

Accordingly, it would be advantageous to provide a closure for a container providing any one or more of these or other advantageous features.

BRIEF DESCRIPTION OF THE DRAWINGS

FIG. 6A is a schematic representation of a top view of a top portion of a closure for a container according to the embodiment of FIG. 1.

FIG. 6B is a schematic representation of a bottom view of a top portion of a closure for a container according to the embodiment of FIG. 1.

FIG. 6C is a schematic representation of a side view of a top portion of a closure for a container according to the embodiment of FIG. 1.

DETAILED DESCRIPTION

Figure 1:
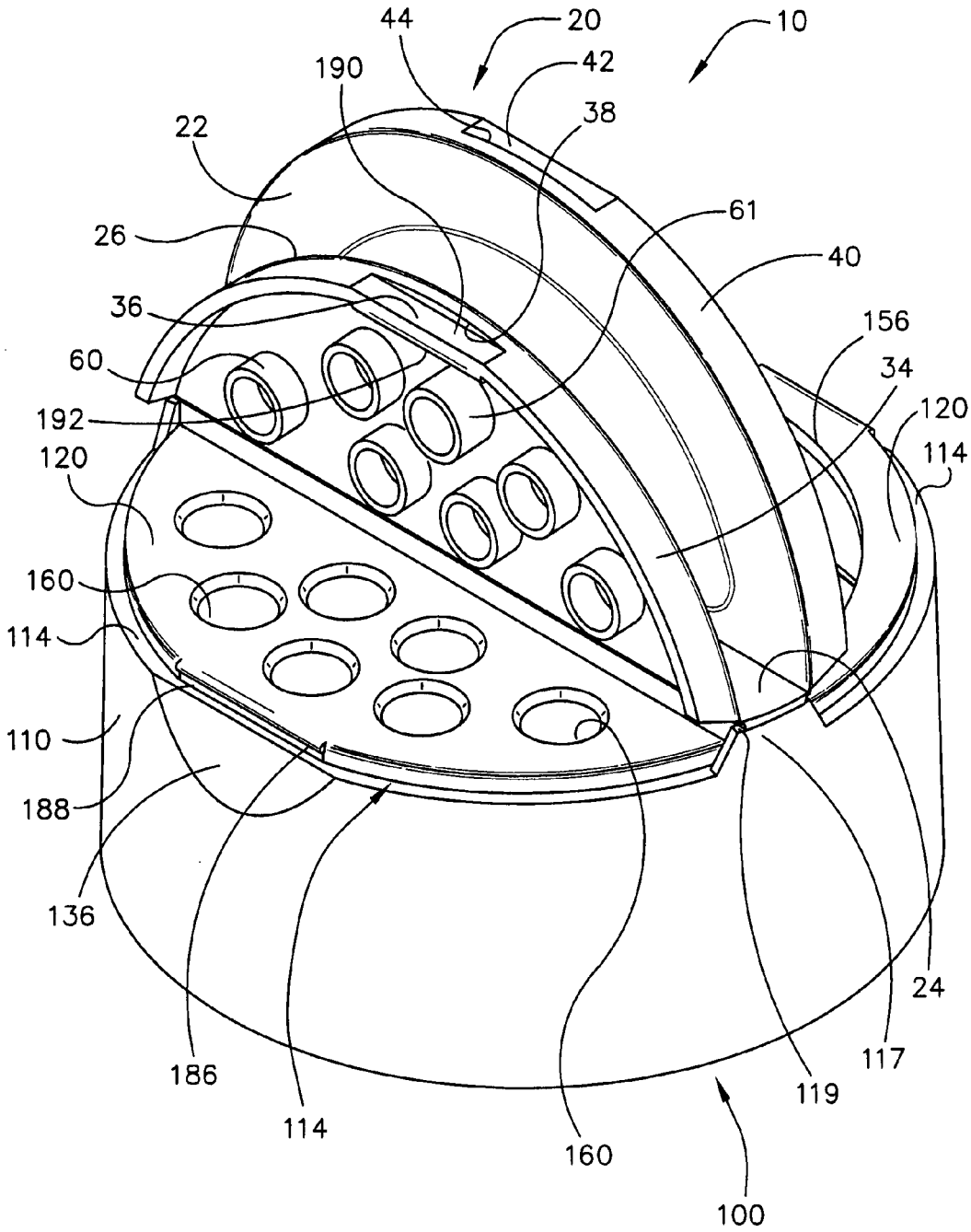
FIG. 1 is a schematic representation of a top perspective view of a shaker side of a closure for a container with flaps in an open position according to one embodiment.

Referring to the FIGURES, a cover or closure for a container is shown according to various exemplary embodiments. According to a preferred embodiment, closure 10 comprises a body shown as body portion 100 and a cover shown as top portion 20. Body portion 100 comprises a side wall section shown as cylindrical skirt 110 and an end wall section shown as generally planar top surface 120 (e.g., platform, top, top surface, etc.). Top surface 120 comprises two sections; in a first section (or side) a plurality of cylindrical (shaker) openings 160 are provided; in a second section (or side) a single generally semi-circular opening 156 is provided. Top surface 120 also comprises a plurality of apertures 172 located between shaker openings 160 and spoon opening 156 (in a central region or mid-section 170) intended to operate as a receiving structure.

Body portion 100 comprises a sealing structure shown as a plurality of cylindrical sealing rings 180 configured to provide an interface with a receptacle on which the closure is mounted. According to any preferred embodiment, the sealing structure can be configured to provide a suitable "seal" with the receptacle and/or a liner which may be provided between the seal structure and the mouth of the receptacle as shown, for example, in U.S. Pat. No. 4,714,181 and U.S. Pat. No. 6,460,718.

Top portion 20 comprises a shaker flap 26 configured to expose shaker openings 160 when shaker flap 26 is in an open position and to cover shaker openings 160 when shaker flap 26 is in the closed position. Top portion 20 also comprises a spoon flap 22 configured to expose spoon opening 156 when spoon flap 22 is in the open position and to cover spoon opening 156 when spoon flap 22 is in the closed position. Top portion 20 further comprises a central region 24 (e.g., mid-section, web, etc.) having a first side 80 defining a shaker flap hinge 82 and a second side 84 defining a spoon flap hinge 86. The underside of central region 24 of top portion 20 comprises an engaging structure (shown schematically as coupling structure 70) configured to engage the plurality of coupling apertures 172 in body portion 100 to secure top portion 20 to body portion 100. According to various exemplary and alternative embodiments, the body portion and the top portion may be formed or otherwise made in separate molds or molding operations and assembled to form the closure. According to any preferred embodiment, the top portion and the body portion will each be formed in a separate "direct-pull" mold in which the mold sections are brought together, injected with moldable plastic, and separated in a high speed linear operation. According to various alternative embodiments, the top portion and body portion may be made in any suitable mold by any suitable molding operation such as a mold and molding operation in which the complexity of the mold is reduced and the number of pieces that may be produced in a given time period is increased.

Figure 2:
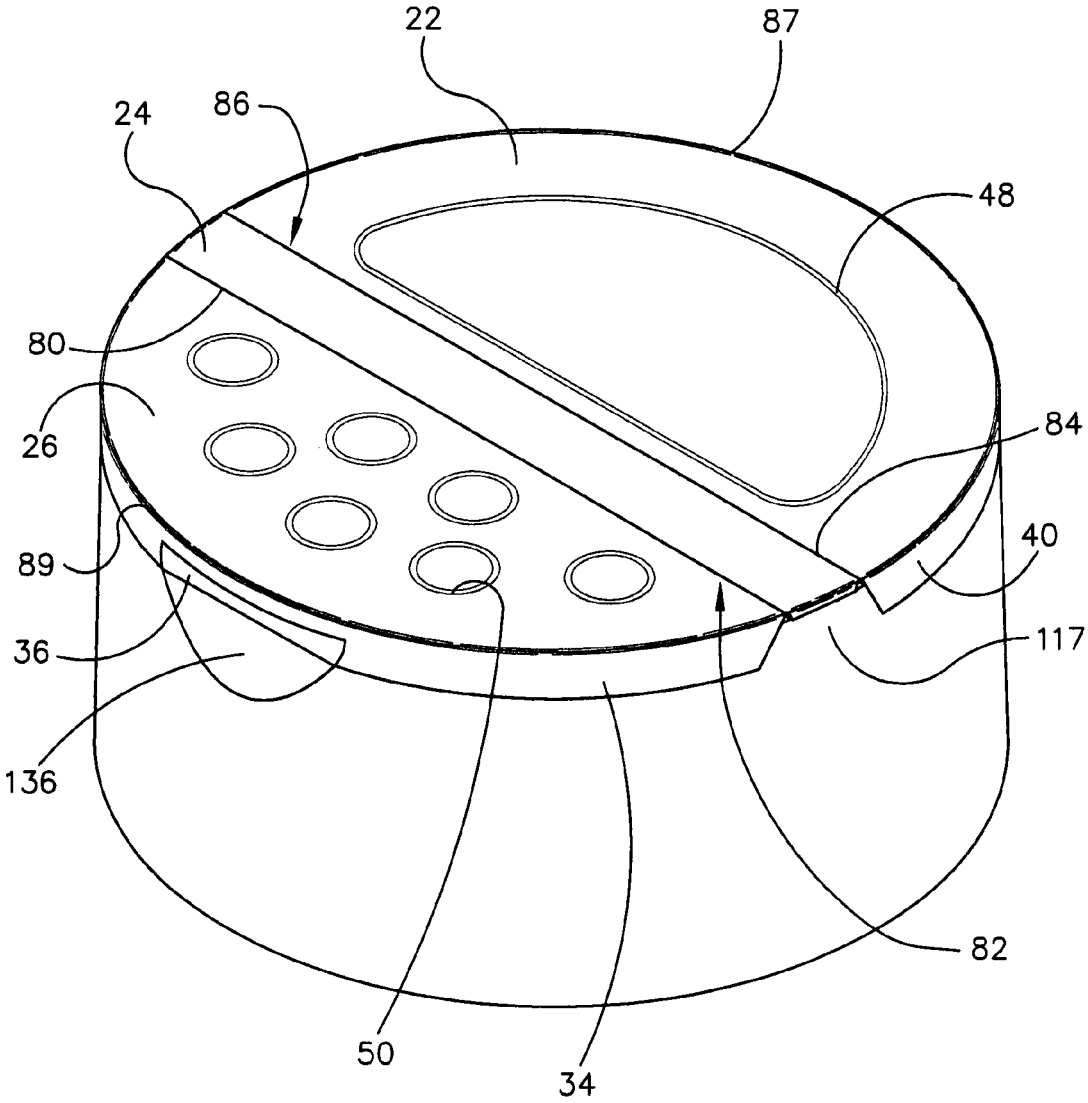
FIG. 2 is a schematic representation of a top perspective view of a shaker side of a closure for a container with flaps in a closed position according to the embodiment of FIG. 1.
Figure 3:
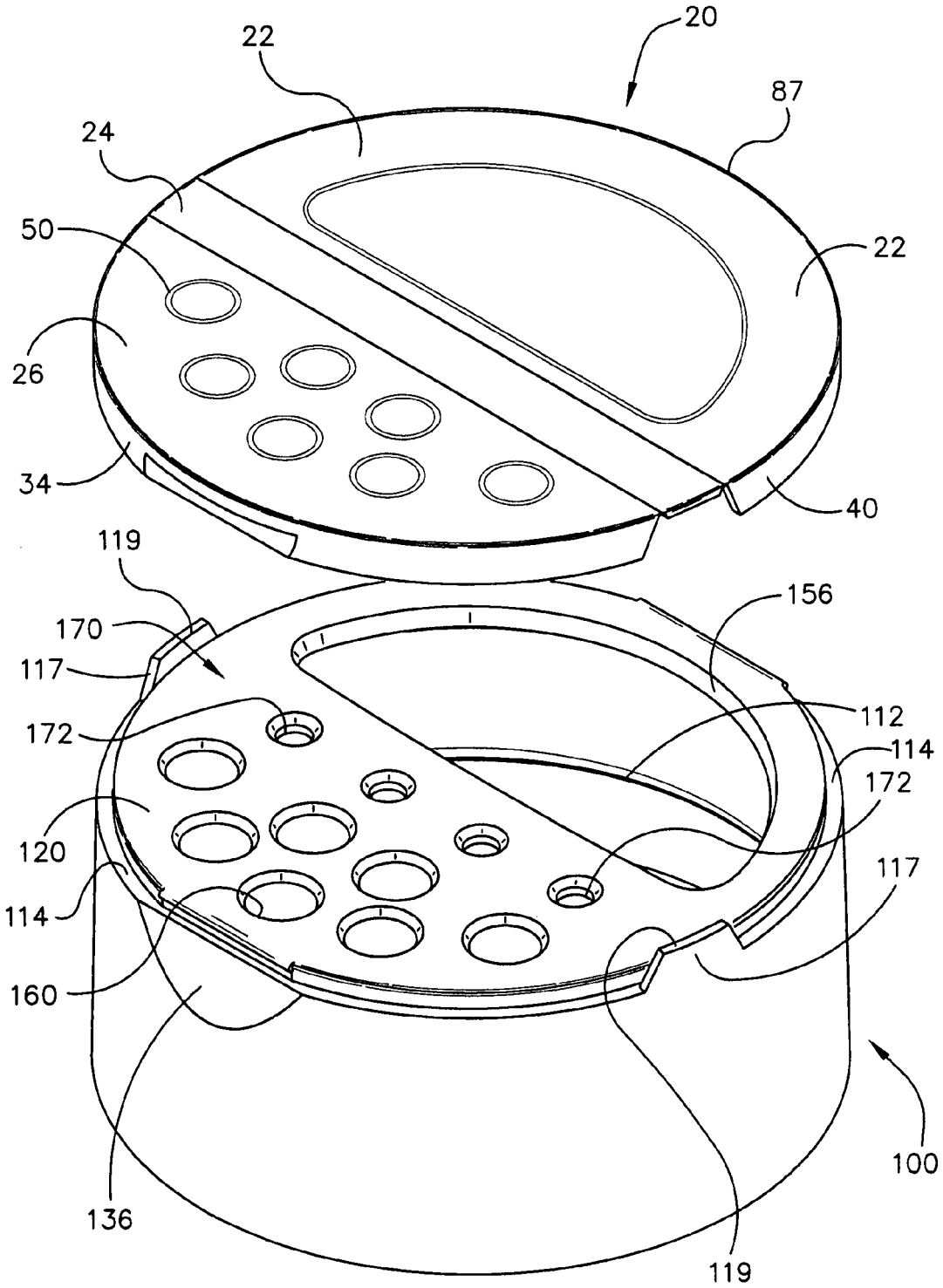
FIG. 3 is a schematic representation of a top exploded perspective view of a shaker side of a closure for a container having a body portion and a top portion according to the embodiment of FIG. 1.

Referring now to FIGS. 1 through 5 and 7A through 8, body portion 100 of the closure 10 is shown according to an exemplary embodiment. Body portion 100 has a side wall section 110 (e.g., skirt) adapted to fit over an end of a conventional receptacle (not shown). According to one exemplary embodiment, side wall section 110 is cylindrical and has a coupling component (e.g., attachment structure) (shown schematically as threads 112 in FIGS. 4 and 5) located on an inside surface for engaging a corresponding coupling component (e.g., threads, etc.) on the receptacle to secure closure 10 to an open end of the receptacle. According to various alternative and exemplary embodiments, the coupling component may be any suitable structure (e.g., press-on rings or snap-fit structure, ribs, etc.) for coupling the closure to the receptacle. Side wall 110 comprises a recess 114 (e.g., cut-out, step, ledge, etc.) along an upper perimeter of side wall 110 and adjacent to an outer edge of end wall 120. Recess 114 is configured to receive a downwardly extending skirt 34 from shaker flap 26 and a downwardly extending skirt 40 from spoon flap 22 (as shown in FIGS. 1 through 3). Side wall 110 also comprises indentations 136 and 142 on opposite sides of body portion 100 (shown schematically in FIGS. 1 through 5) configured to provide planar, angled surfaces that cooperate with corresponding indentations 36 and 42 on shaker flap 26 and spoon flap 22, respectively, to create ledges 38 and 44 (shown schematically for the spoon flap in FIG. 4 and for the shaker flap in FIG. 1) to receive a thumb, finger, etc. of a user for facilitating the opening of flaps 26 and 22 from a closed position.

Figure 7D:
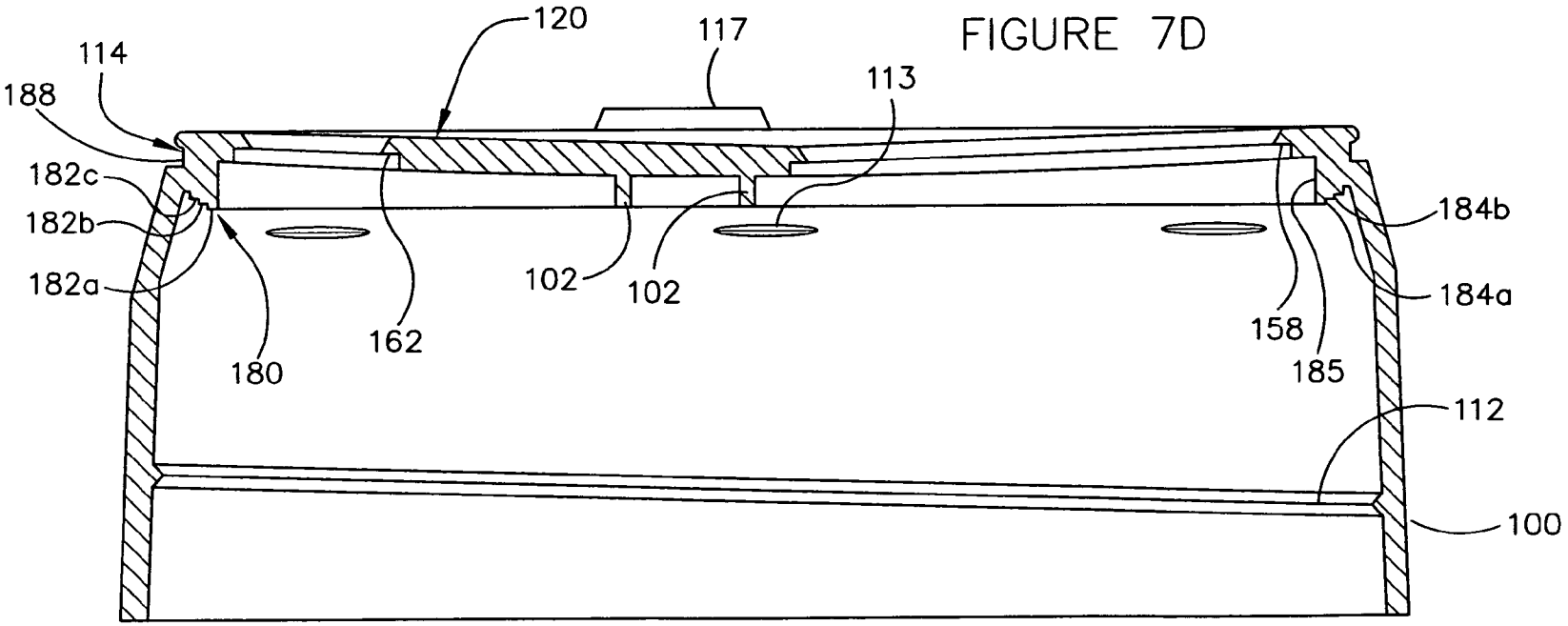
FIG. 7D is a schematic representation of a cross-sectional view of a body portion of a closure for a container taken along line 7D-7D of FIG. 7A.
Figure 8:
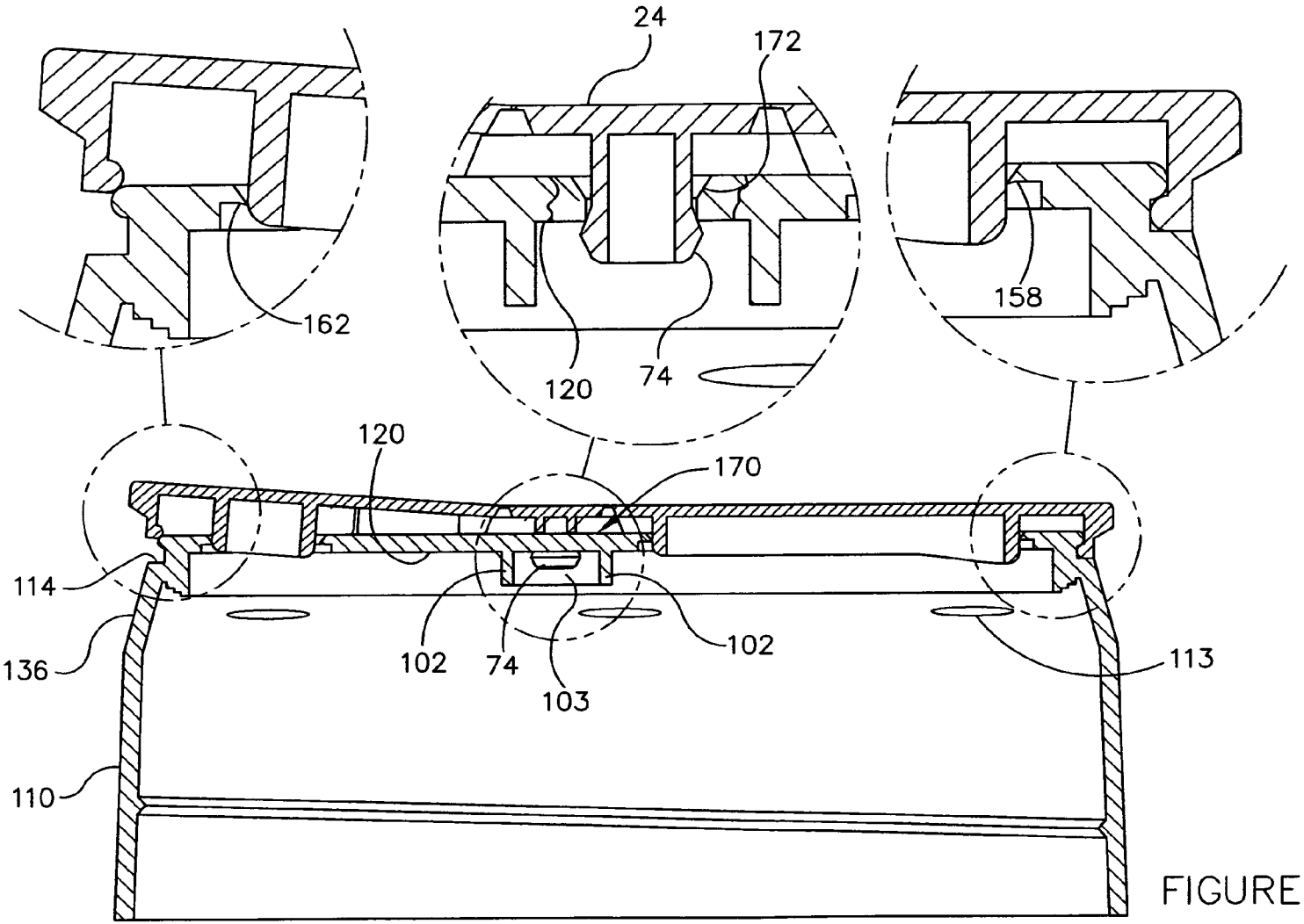
FIG. 8 is a schematic representation of a cross-sectional view of the top portion of the closure for a container of FIG. 6D and the body portion of the closure for a container of FIG. 7D in a coupled configuration.

According to one exemplary embodiment illustrated in FIGS. 7D and 8, the thickness of side wall 110 remains substantially constant from the top end (e.g., the end of side wall 110 closest to end wall 120) to the bottom end (e.g., the end of side wall 110 opposite the top end) of side wall 110.

Figure 9A:
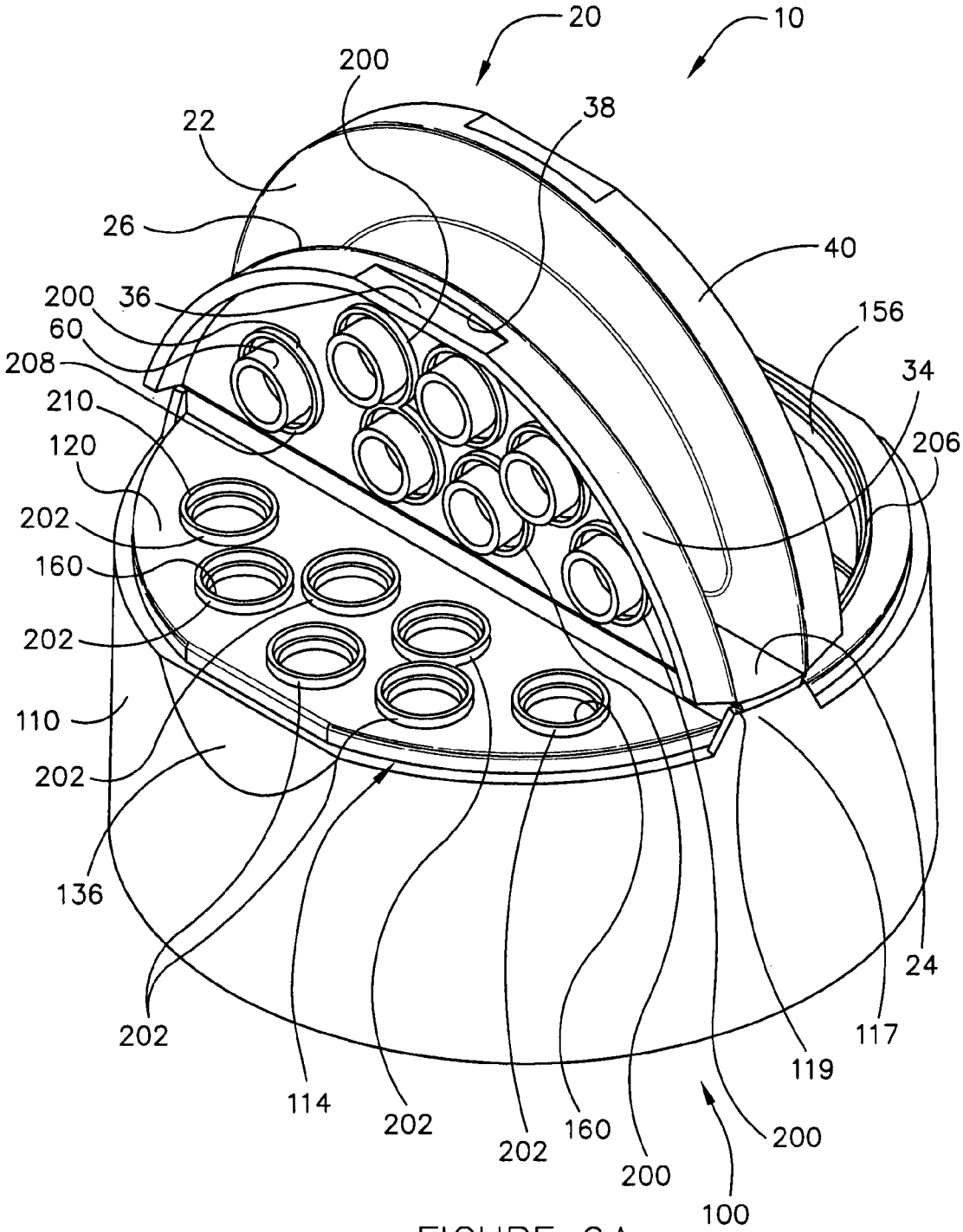
FIG. 9A is a schematic representation of a top perspective view of a shaker side of a closure for a container with flaps in an open position according to another embodiment.
Figure 9B:
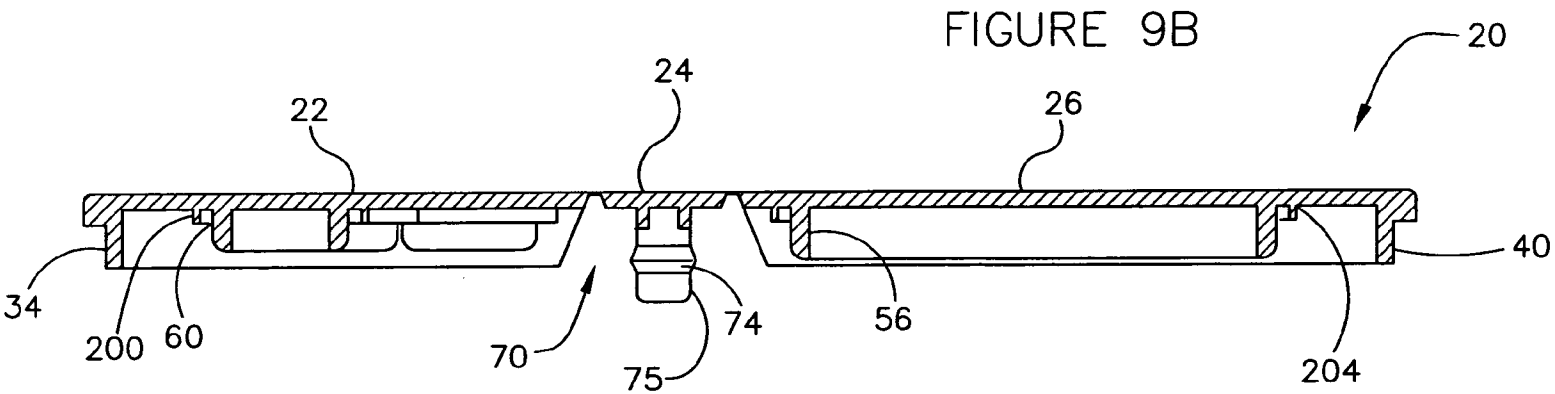
FIG. 9B is a schematic representation of a cross-sectional view of a top portion of a closure for a container according to the embodiment of FIG. 9A.
Figure 9C:
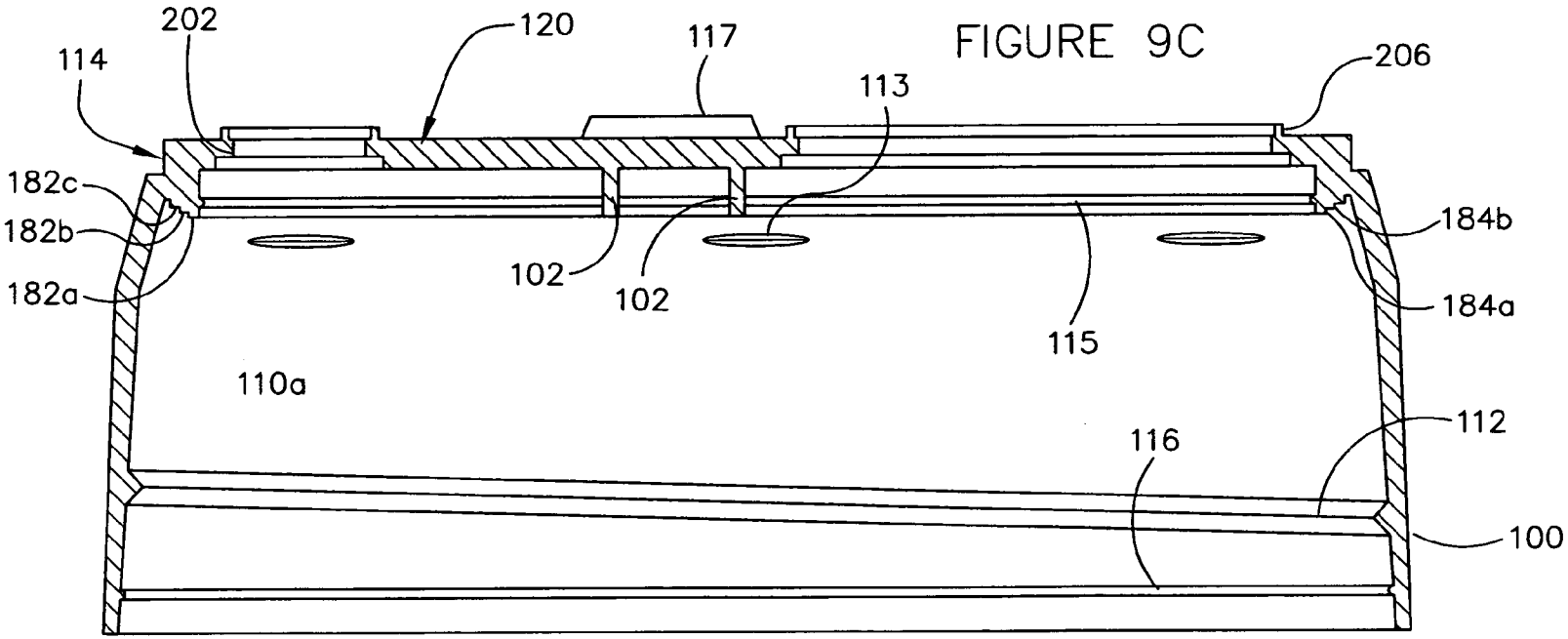
FIG. 9C is a schematic representation of a cross-sectional view of a body portion of a closure for a container according to the embodiment of FIG. 9A.

According to another exemplary embodiment illustrated in FIG. 9C, the thickness of the side wall (shown as side wall 110*a*) reduces as side wall 110*a* extends from the top end to the bottom end such that the thickness of side wall 110*a* near its bottom end is less than the thickness of side wall 110*a* near its top end. The reduction in the thickness of side wall 110*a* as it extends away from end wall 120 is believed to reduce the extent to which body portion 100 takes a noncircular or oval shape when it is removed from the mold. According to various exemplary embodiments, the thickness of the side wall reduces between approximately 70 and 5 percent as it extends away from end wall 120. According to other various exemplary embodiments, the thickness of the side wall reduces between approximately 60 and 30 percent as it extends away from end wall 120. According to another exemplary embodiment, the thickness of the side wall reduces approximately 50 percent as it extends away from end wall 120. According to other various alternative and exemplary embodiments, the thickness of the side wall may reduce more than 70 percent or less than 5 percent as it extends away from end wall 120. According to still another alternative embodiment, the thickness of the side wall may increase as it extends away from the end wall or may otherwise vary along the height of the side wall.

Figure 11:
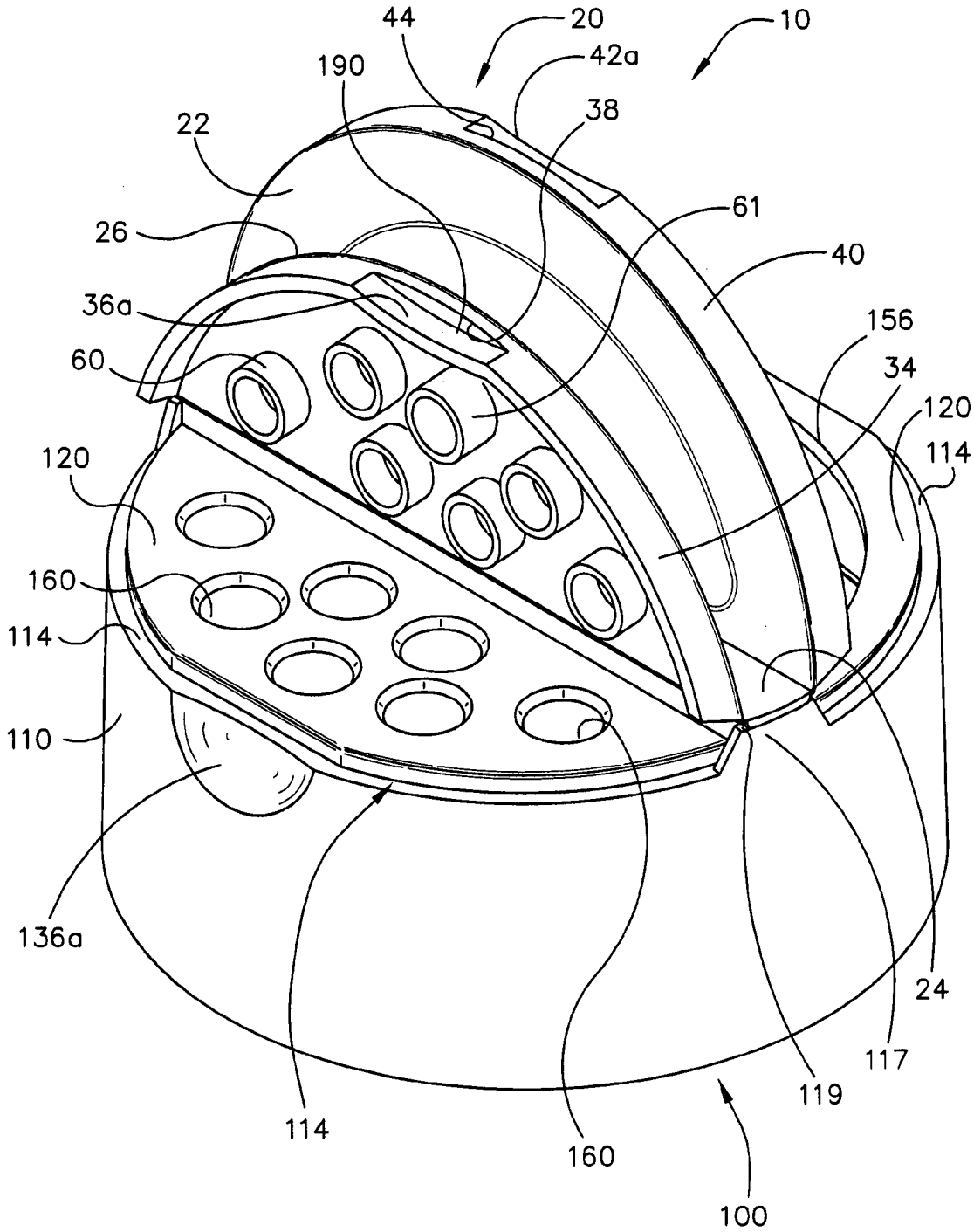
FIG. 11 is a schematic representation of a top perspective view of a shaker side of a closure for a container with flaps in an open position according to another embodiment.
Figure 12A:
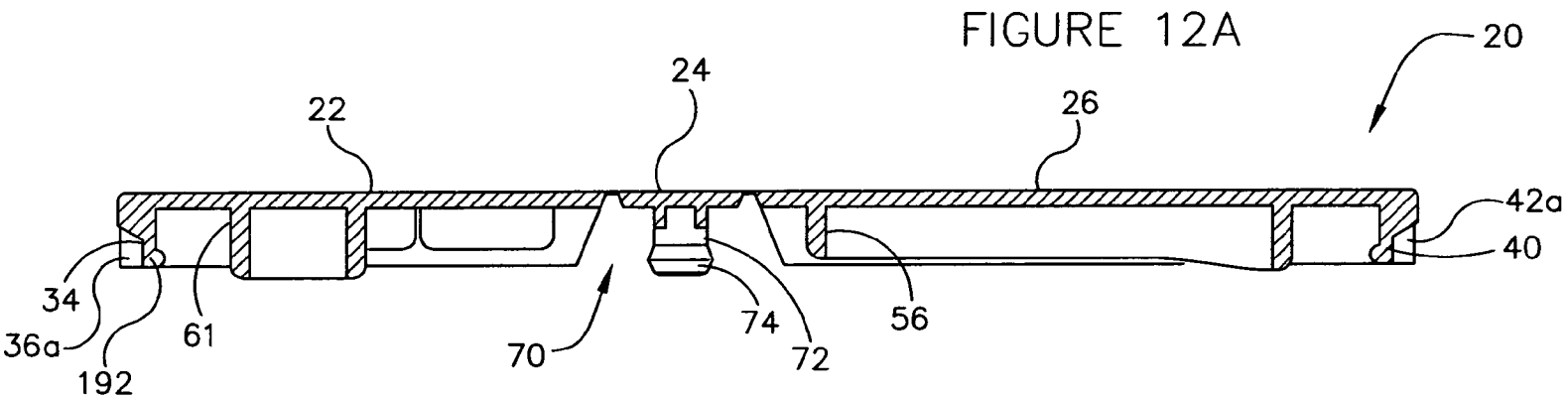
FIG. 12A is a schematic representation of a cross-sectional view of a top portion of a closure for a container according to the embodiment of FIG. 6A.
Figure 12B:
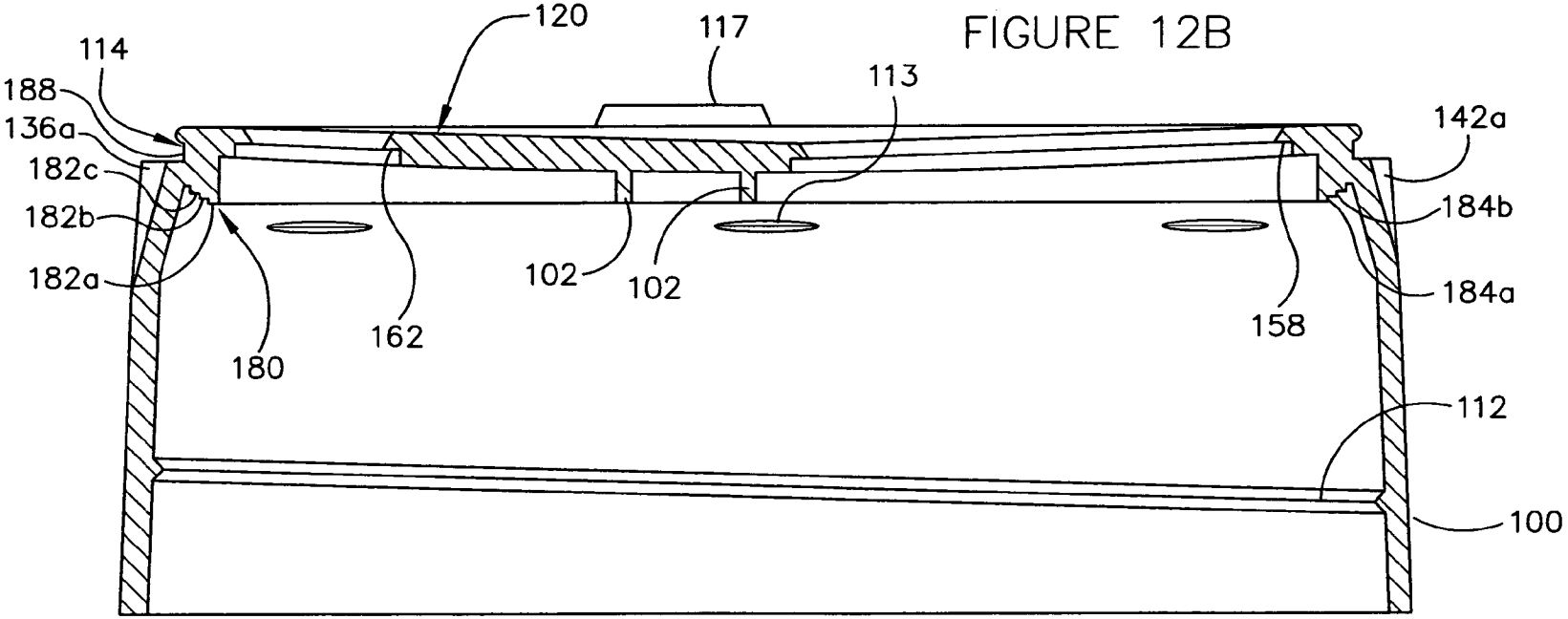
FIG. 12B is a schematic representation of a cross-sectional view of a body portion of a closure for a container according to the embodiment of FIG. 7A.

According to an alternative embodiment illustrated in FIGS. 11, 12A, and 12B, the indentations provided on opposite sides of body portion 100 may have a concave or curved surface rather than a planar surface. Indentations 136*a* and 142*a* of body portion 100 are configured to provide a concave surface that cooperates with a corresponding indentation 36*a* and 42*a* on shaker flap 26 and spoon flap 22, respectively, to create ledges on shaker flap 26 and spoon flap 22 to receive a thumb, finger, etc. of a user for facilitating the opening of flaps 26 and 22 from a closed position. According to various alternative and exemplary embodiments, the indentations provided on the body portion may have any one of a variety of different shapes, sizes, and contours. According to other various alternative and exemplary embodiments, the body portion may not include any indentations.

Body portion 100 further comprises projections 117 (e.g., extensions, protrusions, braces, legs, supports, etc.) that extend upward from the outer edge of recess 114 beyond end wall 120. Projections 117 are located on opposite sides of body portion 100 proximate each end of a central region 170 of end wall 120 and have the appearance of a continuous extension of side wall 110. Projections 117, which according to one exemplary embodiment are spaced apart from the substantially vertical surface of recess 114, are substantially rectangular in cross-section and follow the rounded shape of side wall 110. Each side of projection 117 is shaped (e.g., angled, sloped, etc.) to avoid interfering with skirts 40 and 34 on flaps 22 and 26 as flaps 22 and 26 are closed. A top surface 119 of each projection 117 provides a surface that may provide support for a portion of top portion 20. According to one exemplary embodiment illustrated in FIG. 7A, two members 118 (e.g., ribs, gussets, supports, fins, etc.) extend between each projection 117 and the corresponding vertical surface of recess 114. Members 118 are intended to support and rigidify projections 117. According to various alternative and exemplary embodiments, the members 118 may take one of a variety of different shapes, sizes, and configurations and may be provided in different numbers (e.g., only one member may extend between each projection 117 and recess 114, or more than two members may extend between each projection 117 and recess 114). According to other various alternative embodiments, the projections may be various sizes, thicknesses, shapes, locations, and orientations. According to other alternative embodiments, the projections may not be spaced apart from the substantially vertical surface of the recess. According to other various alternative embodiments, the projections may extend any length either upward from the recess and/or circumferentially around the periphery of the body portion. For example, the projections may extend a distance that makes the top surface of each projection substantially level with the end wall of the body portion.

Body portion 100 further comprises end wall 120 which is shown as being oriented perpendicular to a central axis of side wall 110. According to one exemplary embodiment, end wall 120 and side wall 110 are integrally formed as a single unitary body in a single mold by an injection molding operation to form body portion 100. According to various other exemplary and alternative embodiments, the end wall section and the side wall may be formed separation and may be coupled together in any suitable manner (e.g., snap-fit, etc.). According to another exemplary embodiment, side wall 110 may be slightly tapered (e.g., frustoconical, etc.) such that the diameter of side wall 110 near the top of body portion 100 is slightly smaller than the diameter of side wall 110 near the bottom of body portion 100. This slight taper (which may be as small as several thousandths) is intended to reduce the potential for interference with machinery that may be used to couple closure 10 to a receptacle.

End wall 120 comprises a plurality of shaker openings 160 (shown schematically as seven relatively small circular openings configured at least partially in an semi-circular pattern). Each of shaker openings 160 comprises a peripheral edge recess 162 on the underside of end wall 120 (shown schematically in FIGS. 4, 5, and 7D) that provides an area of reduced thickness (relative to other portions of end wall 120) surrounding openings 160. The area of reduced thickness is intended to provide a relatively thin, flexible region (e.g., flap, cantilever, etc.) around openings 160 to facilitate the sealing and retention features provided by the interfaces between openings 160 and skirts 60. According to various alternative and exemplary embodiments, the shaker openings may have any suitable shape, size, number and pattern (e.g., including that described in U.S. patent application Ser. No. 29/168,190, filed on Sep. 27, 2002, incorporated by reference herein) to suit the desired application and material to be dispensed from the container. For example, the end wall may include one shaker opening or it may include two or more shaker openings, and each shaker opening may have a shape and size that is suitable to the application in which the closure will be used. For example, one or more of the shaker openings may be circular, rectangular, tear-drop shaped, football-shaped, half moon-shaped, or one of a variety of other shapes.

End wall 120 also comprises spoon opening 156 (shown schematically as occupying approximately one-half of the area of end wall 120). Spoon opening 156 comprises a peripheral edge recess 158 on the underside of end wall 120 (shown schematically in FIGS. 5 and 7D) that provides an area of reduced thickness that is intended to provide a relatively flexible region (e.g., flap, cantilever, etc.) around opening 156, in a similar manner to edge recesses 162. According to one exemplary embodiment, the portion of end wall 120 surrounding and defining the curved portion of spoon opening 156 is relatively wide, which is intended to help reduce any ovality in body portion 100. According to various alternative and exemplary embodiments, the portion of end wall 120 that surrounds and defines spoon opening 156 has a width between approximately 0.100 inches and 0.250 inches. According to other alternative and exemplary embodiments, the portion of end wall 120 that surrounds and defines spoon opening 156 has a width between approximately 0.135 inches and 0.210 inches. According to other alternative and exemplary embodiments, the portion of end wall 120 that surrounds and defines spoon opening 156 has a width of approximately 0.200, 0.180, or 0.140 inches. According to other alternative and exemplary embodiments, the portion of end wall 120 that surrounds and defines spoon opening 156 may have a width greater than 0.250 inches or less than 0.100 inches. According to other various alternative and exemplary embodiments, the spoon opening may have any suitable shape and size, may comprise more than one opening, and may have any suitable pattern to suit the desired application and material to be dispensed from the container. For example, the spoon opening may be configured to receive a utensil other than a spoon, such as a measuring cup or a pair of tongs.

Figure 7A:
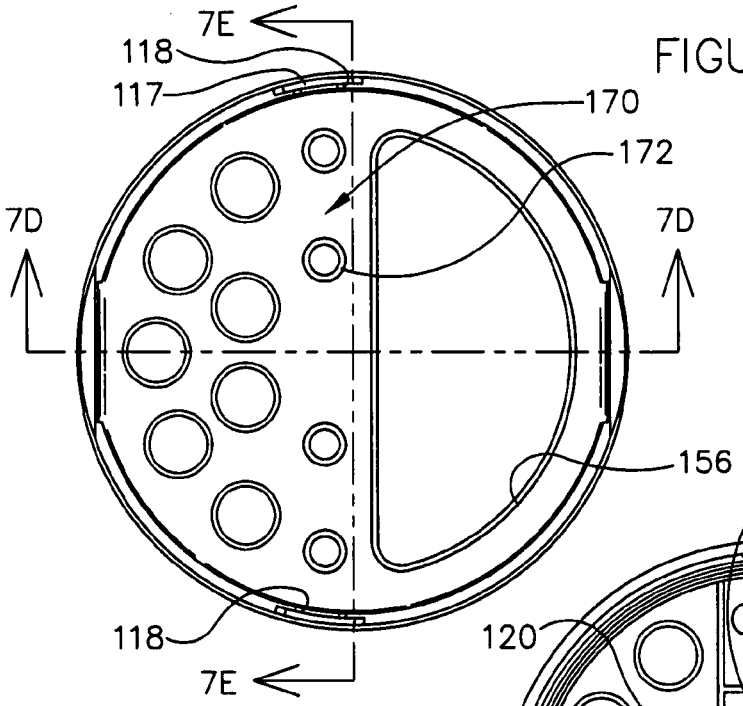
FIG. 7A is a schematic representation of a top view of a body portion of a closure for a container according to the embodiment of FIG. 1.
Figure 7B:
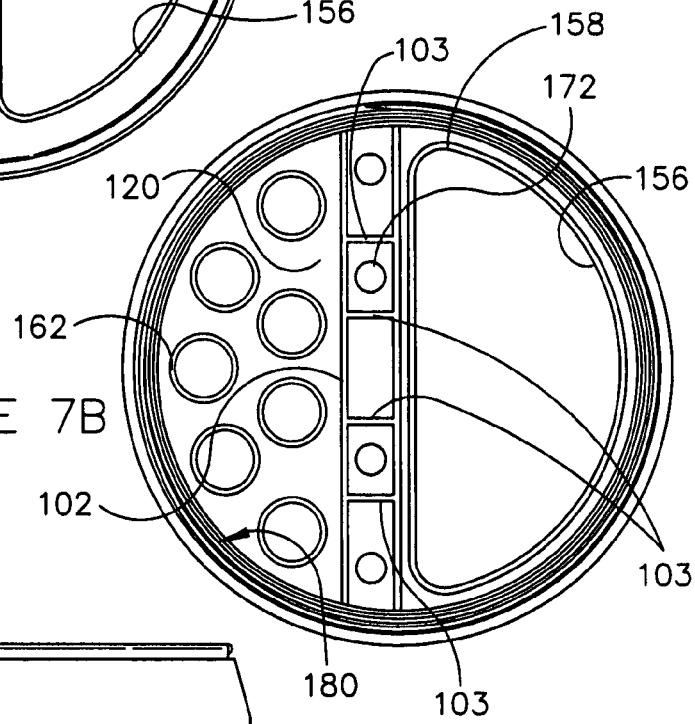
FIG. 7B is a schematic representation of a bottom view of a body portion of a closure for a container according to the embodiment of FIG. 1.
Figure 7C:
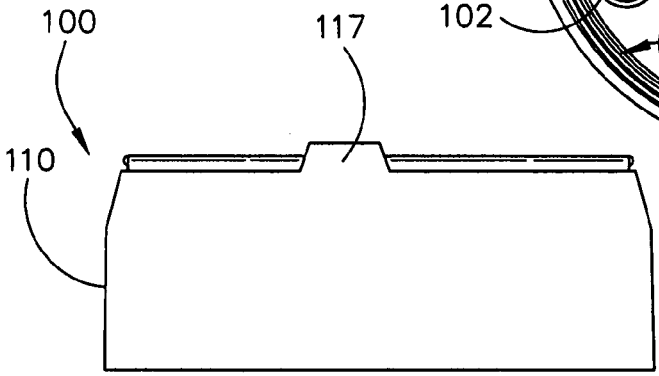
FIG. 7C is a schematic representation of a side view of a body portion of a closure for a container according to the embodiment of FIG. 1.

End wall 120 further comprises receiving structure (e.g., shown schematically as a plurality of coupling apertures 172, etc.—shown as four coupling apertures in FIGS. 3, 7A, and 7B) located in central region 170 of end wall 120 (shown schematically as approximately midway between shaker openings 160 and spoon opening 156). According to one exemplary embodiment, coupling apertures 172 are circular and have a diameter on the top side of end wall 120 that is greater than the diameter on the bottom side of end wall 120 to create a receiving profile (e.g., funnel-shape, cone, wedge, countersink, taper, etc.—see FIGS. 3 and 8) to receive the corresponding coupling structure provided on top portion 20. According to other exemplary and alternative embodiments, any number of coupling apertures may be provided in the end wall to correspond to the coupling structure of the top portion. According to other exemplary and alternative embodiments, the coupling apertures may take any one of a plurality of different shapes (e.g., square, triangular, oval, rectangular, trapezoidal, tear-drop shaped, football shaped, etc.). According to other alternative embodiments, the receiving structure may include pegs, projections, or other types of suitable coupling structures that are configured to cooperate with corresponding structure or structures provided on the top portion.

Referring to FIGS. 4, 5, 7B, 7D, and 8, two substantially parallel stiffening ribs 102 are shown coupled to the underside of end wall 120 and extend across the underside surface of end wall 120. Among other functions, stiffening ribs 102 are intended to provide structural support for end wall 120. Four lateral ribs 103 extend perpendicularly between stiffening ribs 102 and are intended to increase the rigidity of closure 10. According to one exemplary embodiment, one lateral rib is located between each of coupling apertures 172, with the exception of the area between the two inside coupling apertures 172, in which there are two ribs 103. According to various alternative and exemplary embodiments, there may be more or less than four lateral ribs, and the lateral ribs may be located in various positions along the length of the stiffening ribs (e.g., between the ribs, on the outside of the ribs, etc.), with zero, one, two, or more than two lateral ribs between each of the coupling apertures in the end wall of the body portion. According to other various alternative and exemplary embodiments, one or more of the lateral ribs may extend the entire distance between the stiffening ribs or may extend only a portion of the distance between stiffening ribs (e.g., in the form of a gusset, bracket, or brace). According to other exemplary and alternative embodiments, one, two, or more than two stiffening ribs may be coupled to the underside of the end wall, and may or may not be used in conjunction with one, two, three, or more than four lateral ribs. According to other exemplary and alternative embodiments, one or more of the stiffening ribs and/or the lateral ribs may serve as an injection passageway (e.g., "fill line", "flow-rib", etc.) during the injection molding operation and may have an increased width or height (e.g., thickness) to facilitate a more rapid distribution of plastic material and allow for improved "controllability" of the shape (e.g., shrinkage, sinkage, warping, distortion, etc.) of the body portion during and after the molding operation. According to one exemplary embodiment, stiffening ribs 102 and lateral ribs 103 extend downward from end wall 120 by a distance that places the lower end of the ribs flush with the sealing surface of sealing structure 180. This facilitates the installation of closure 10 over a liner that may be placed between the sealing structure of closure 10 and the end of the receptacle to which closure 10 is coupled. According to various alternative and exemplary embodiments, the height or length of the ribs may be greater or less than the height of the sealing structure, and, according to one embodiment, may range from between half the height or length of the sealing structure to equal to the height of the sealing structure. According to other various alternative and exemplary embodiments, the different ribs may have different heights. For example, one or both of the parallel ribs may have a greater height or length than one or more of the lateral ribs. According to one exemplary embodiment, the thickness of ribs 102 and 103 are approximately 0.010-0.115 inches less than the nominal wall thickness of closure 10, but according to other exemplary and alternative embodiments, may be greater than, equal to, or less than the nominal wall thickness of the closure.

Referring to FIGS. 1 through 6D and 8, top portion 20 of closure 10 is shown according to an exemplary embodiment. Top portion 20 is circular and has a diameter corresponding approximately to the diameter of side wall 110 of body portion 100 such that when top portion 20 is coupled to body portion 100, top portion 20 and body portion 100 provide a smooth and uniform appearance. According to one exemplary embodiment, top portion 20 comprises shaker flap 26, spoon flap 22, and central region 24 (e.g., web, panel, bridge, strip, border, etc.) that are integrally-formed as a single unitary body in an injection molding operation.

According to one exemplary embodiment, central region 24 is diametrically offset relative to the periphery of top portion 20 to assist in increasing the rigidity of top portion 20. According to any exemplary embodiment, central region 24 provides a structure for joining shaker flap 26 and spoon flap 22 and for providing an engaging structure (shown schematically in FIG. 5 as coupling structure 70) for engaging the receiving structure (e.g., coupling apertures 172) on body portion 100. According to one exemplary embodiment, the configuration of the engaging structure and the receiving structure is of a type shown in U.S. Pat. No. 5,219,100 (and products presently commercialized by Kraft Foods and marked with U.S. Pat. No. 5,219,100). According to various exemplary and alternative embodiments, the top portion may have any suitable structure that joins the shaker flap and the spoon flap and/or any suitable structure that facilitates the coupling of the top portion to the body portion (e.g., slide devices, fasteners, adhesives, etc.). According to an alternative embodiment, the top portion may include only one of the shaker flap and the spoon flap, such as when the closure is configured to be coupled to a relatively small receptacle.

According to an exemplary embodiment, spoon flap 22 has an interior edge 84 that is straight and that extends across top portion 20 in the form of a chord and defines a hinge 86 between spoon flap 22 and central region 24. Hinge 86 is shown as provided by a linear groove 85 (e.g., slot, cut away, recess, crevice, channel, etc.) or other suitable shape providing a line of reduced thickness about which spoon flap 22 can move or pivot relative to central region 24. Spoon flap 22 has an outer edge 87 that extends from opposite ends of interior edge 84 and has a circular profile that corresponds to an outer edge of side wall 110 and comprises a downwardly extending skirt 40. Downwardly extending skirt 40 is shown having a thickness approximately equal to the thickness of side wall 110 and a depth configured to fit within recess 114 on side wall 110 when spoon flap 22 is in a closed position. The depth and thickness of skirt 40 are intended to provide a degree of rigidity to spoon flap 22. According to another exemplary embodiment, the depth and thickness of the skirt are also intended to provide an outer closure system for the spoon flap. Skirt 40 comprises indentation 42 (e.g., recess, etc.) that is formed by a straight lower segment of skirt 40 to provide a ledge 44 that may be used as a bearing surface for a user's thumb, finger, etc. for opening spoon flap 22. Spoon flap 22 may also be provided with indicia 48 (e.g., markings, formations, etc.—shown schematically as a "half-moon" corresponding to the spoon opening) that provides a general indication of the nature of the opening that is located beneath the flap.

Referring now to FIGS. 1 through 3, 5 through 6D and 8, shaker flap 26 has an interior edge 80 that is straight and that extends across top portion 20 in the form of a chord and defines a hinge 82 between shaker flap 26 and central region 24. According to one exemplary embodiment, hinge 82 is parallel to hinge 86 on spoon flap 22 and is substantially similar to hinge 86. Shaker flap 26 has an outer edge 89 that extends from opposite ends of the interior edge 80 and has a circular profile that corresponds to an outer edge of side wall 110. Shaker flap 26 also comprises a downwardly extending skirt 34 having an indentation 36. Downwardly extending skirt 34 and indentation 36 are substantially similar to skirt 40 and indentation 42. Shaker flap 26 may also be provided with indicia 50 (e.g., markings, formations, etc.—shown schematically as seven circles corresponding to the size and position of the plurality of shaker openings) that provide a general indication of the nature of the opening(s) that are located beneath shaker flap 26.

Figure 13:
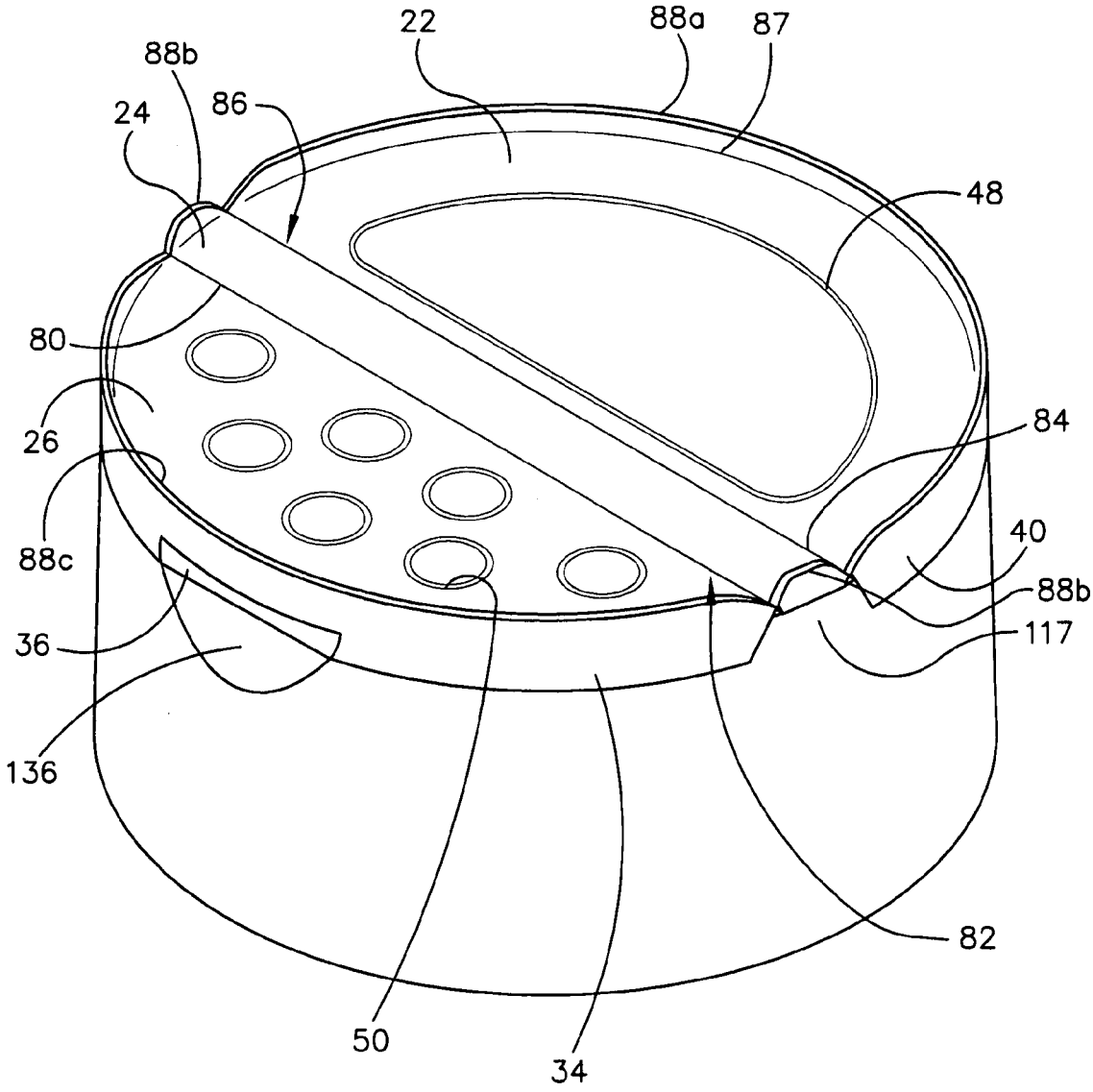
FIG. 13 is a schematic representation of a top perspective view of a shaker side of a closure for a container with flaps in a closed position according to another embodiment.
Figure 14:
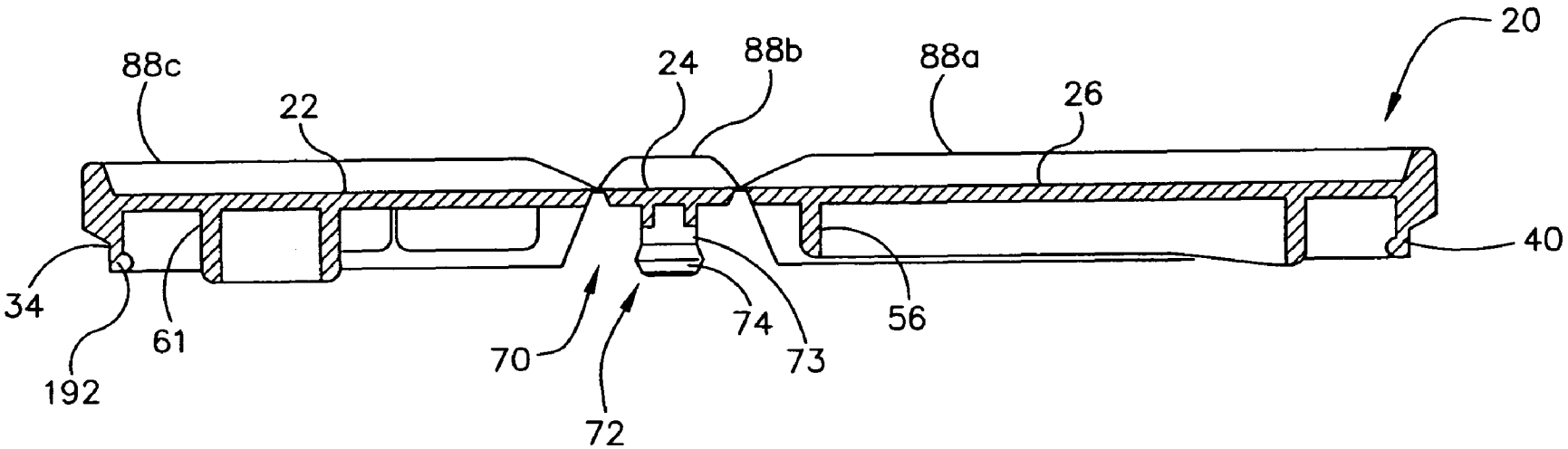
FIG. 14 is a schematic representation of a cross-sectional view of a top portion of a closure for a container according to the embodiment of FIG. 13.

According to an alternative embodiment illustrated in FIGS. 13 and 14, each of spoon flap 22, central region 24, and shaker flap 26 comprise a raised skirt, stacking lip, or nesting ring, etc. shown as rims 88*a*, 88*b*, and 88*c*, respectively, that extend substantially around the outer edge or edges of spoon flap 22, central region 24, and shaker flap 26. Rims 88*a*, 88*b*, and 88*c* each have a rectangular cross-section with rounded edges. The height and width of rims 88*a*, 88*b*, and 88*c* may be configured such that a bottom surface of a receptacle (not shown) of a conventional container that is stacked on top of the closure may be supported directly on the top portion such that rims 88*a*, 88*b*, and 88*c* restrain the receptacle from significant lateral movement. Each of rims 88*a*, 88*b*, and 88*c* may include a portion (e.g., a "transition zone") at one or both ends of the rim where the height of the rim is gradually reduced or tapered to the level of the top portion. In the so-call "transition zone," rims 88*a*, 88*b*, and 88*c* may have a shallow slope and rounded edges to provide a smooth surface. According to various exemplary and alternative embodiments, the cross-sectional shape of the rims may be any suitable shape (e.g., triangular, trapezoidal, rounded, L-shaped, etc.). According to other alternative and exemplary embodiments, the height and width of the rims may be provided in any suitable range such as, for example, a height and a width that do not cause the bottom of a "stacked" container to be "lifted" or elevated above the top surface of the top portion. According to other alternative and exemplary embodiments, a rim may be provided on each of the spoon flap, central region, and the shaker flap; on only one of the spoon flap, the central region, or the shaker flap; or on any combination of the spoon flap, the central region, or the shaker flap.

According to an alternative embodiment illustrated in FIGS. 11, 12A, and 12B, the indentations provided on skirts 34 and 40 of shaker flap 26 and spoon flap 22, respectively, may be formed by a curved segment of each skirt rather than a straight segment. Indentations 36*a* and 42*a* are formed by a curved lower segment of skirt 34 and skirt 40, respectively, to provide a concave surface that cooperates with corresponding indentations 136*a* and 142*a* on body portion 100. The indentations 36*a* and 42*a* create ledges on shaker flap 26 and spoon flap 22, respectively, that may be used as bearing surfaces for a user's thumb, finger, etc. for opening flaps 26 and 22 from a closed position. According to various alternative and exemplary embodiments, the indentations provided on the shaker flap and the spooning flap may have any one of a variety of different shapes, sizes, and contours. According to other various alternative and exemplary embodiments, the shaker flap and the spooning flap may not include any indentations.

According to various exemplary and alternative embodiments, the heights of the shaker flap and the spoon flap (e.g., the heights of skirts 34 and 40, respectively) are between approximately 10 and 40 percent of the total height of the closure (e.g., the distance between the bottom of side wall 110 and the top surface of top portion 20). According to other various exemplary and alternative embodiments, the heights of the shaker flap and the spoon flap are between approximately 15 and 35 percent of the total height of the closure. According to other various exemplary and alternative embodiments, the heights of the shaker flap and the spoon flap are either between approximately 18 and 23 percent of the total height of the closure or between approximately 25 and 32 percent of the total height of the closure. According to other various alternative and exemplary embodiments, the heights of the shaker flap and the spoon flap may be any percentage of the height of the closure depending on the particular application for which the closure will be used.

Referring now to FIGS. 3, 5, 6B through 6D, 7A through 7B, and 8, the engaging structure for body portion 100 and top portion 20 is shown according to an exemplary embodiment. According to various exemplary and alternative embodiments, the engaging structure is configured to permit body portion 100 and top portion 20 to be coupled to each other to provide a closure for use with a receptacle. Top portion 20 comprises engaging structure (shown schematically as coupling structure 70) extending from an underside of central region 24. According to one exemplary embodiment, coupling structure 70 comprises two ribs 71 (e.g., bars, beams, supports, etc.) and four projections 72 (e.g., legs, tubes, plugs, etc.), each shown having a cylindrical base 73 and a lower, outer ridge 74 (e.g., rib, collar, barb, etc.). End wall 120 of body portion 100 has a central region or section 170 that comprises receiving structure (shown schematically as coupling apertures 172) that correspond in location to projections 72. Projections 72 are configured to extend into apertures 172 such that ridges 74 engage the lower surface of end wall 120 or lower corner of apertures 172 (e.g., as shown schematically in FIG. 8) to retain top portion 20 in a coupled relationship with body portion 100. Projections 72 and coupling apertures 172 are shown located along a chord that is offset from a diameter of body portion 100 and top portion 20. The offset is intended to permit top portion 20 to be coupled to body portion 100 in only a single orientation where spooning flap 22 is positioned over spooning opening 156 and shaker flap 26 is positioned over shaker openings 160.

Figure 10:
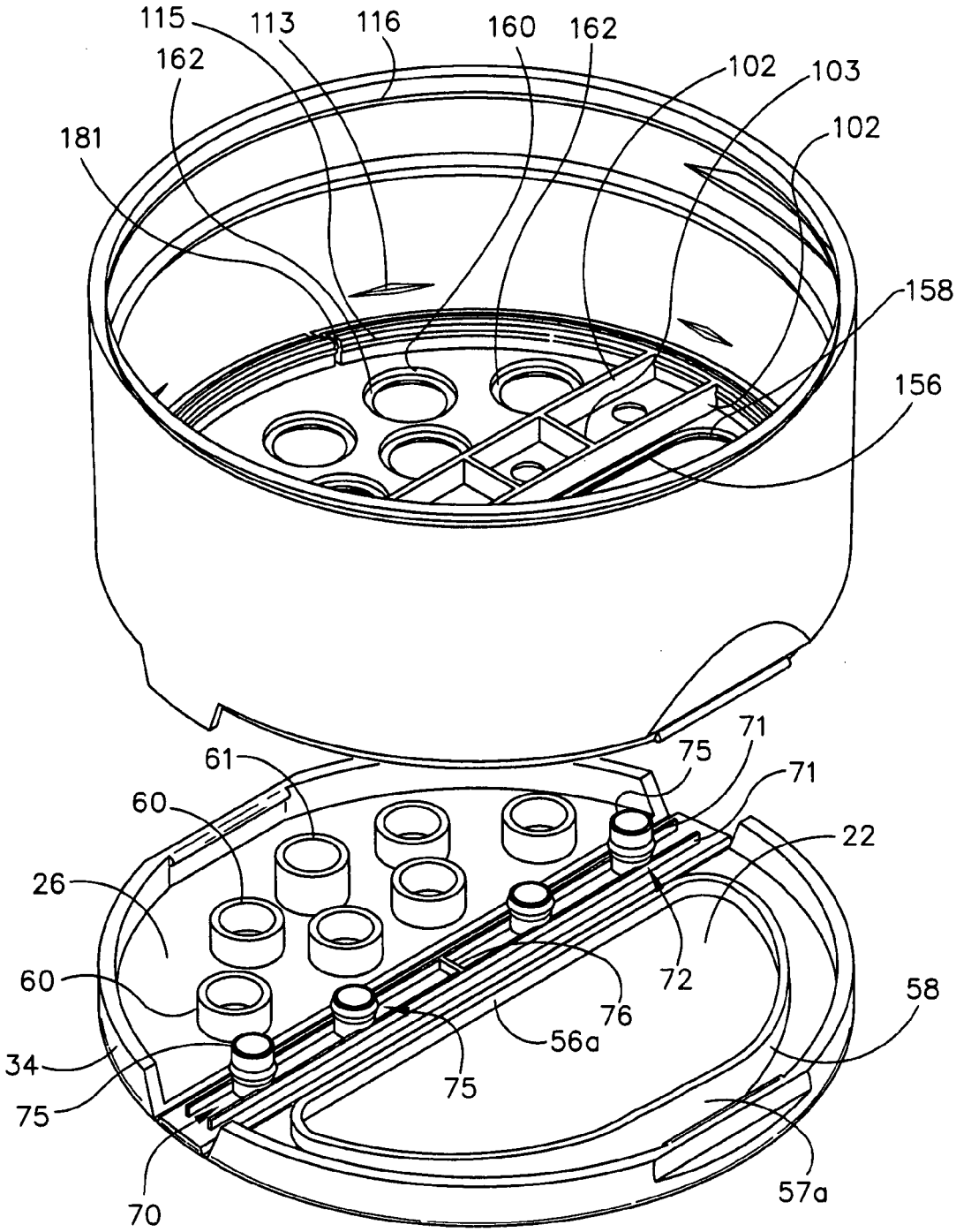
FIG. 10 is a schematic representation of a bottom exploded perspective view of a spoon side of a closure for a container having a body portion and a top portion according to another embodiment.

According to another exemplary embodiment shown in FIGS. 9B and 10, the two outside projections 72 each comprise an extension 75 that extends downwardly (e.g., away from top portion 20) from base 73 and ridge 74. Extensions 75 have the effect of making the two outside projections 72 longer than the two inside projections 72 such that when top portion 20 is being coupled to body portion 100, only the two outside projections 72 (rather than all four of projections 72) need to be initially aligned with the corresponding apertures 172 in body portion 100.

According to various exemplary and alternative embodiments, the projections may take any one of a plurality of different shapes (e.g., square, triangular, oval, rectangular, trapezoidal, tear-drop shaped, football shaped, etc.) and be provided in different numbers to correspond to the receiving structure provided within the end wall. According to other various alternative and exemplary embodiments, the extensions may be provided on any of the projections (e.g., the inner projections, one inner and one outer projection, etc.) and may be provided on one, three, or any number of the projections. According to still other alternative and exemplary embodiments, the extensions may be the same size and shape as the base of the projections so as to effectively elongate the base, or the extensions may take any one of a variety of different shapes and sizes.

According to one exemplary embodiment, ribs 71 protrude from the underside of central region 24 of top portion 20 and extend substantially across the length of central region 24, with one rib 71 on the shaker flap side of projections 72 and one on the spoon flap side of projections 72. The end (e.g., the distal end or bottom) of each rib 71 is flat. So as to not interfere with the relationship of central region 24 and projections 117 of body portion 100, ribs 71 are shown as not extending to the ends of central region 24. Ribs 71 are shown substantially parallel and are spaced apart such that the distance between the outside edges of ribs 71 is substantially the same as the diameter of bases 73 of projections 72 (e.g., the outside edge of each rib 71 is substantially tangent to the circumference of bases 73). Ribs 71 are intended to provide support and rigidity to top portion 20, limit the extent to which projections 72 may extend into apertures 172 (e.g., ribs 71 may act as a support, brace, positioner, travel stop, locator, etc.), and eliminate "play" between top portion 20 and body portion 100. According other exemplary and alternative embodiments, the ribs may extend across the central portion of the top portion continuously or intermittently, and may have different or varying thicknesses and heights. According to other alternative embodiments, the ribs may not intersect or contact the projections. According to another alternative embodiment illustrated in FIG. 10, one or more structures (e.g., gussets, brackets, braces, supports, etc.) shown as lateral ribs 76 may be provided that extend perpendicularly between ribs 71. According to various alternative and exemplary embodiments, the lateral ribs 76 may be provided in any number and at any locations along ribs 71, and may be provided between ribs 71 or on the outside of ribs 71. According to other various alternative and exemplary embodiments, one or more of the lateral ribs may extend the entire distance between ribs 71 or may extend only a portion of the distance between ribs 71 (e.g., in the form of a gusset, bracket, or brace). According to other exemplary and alternative embodiments, one or more of the ribs 71 and 76 may serve as an injection passageway (e.g., "fill line", "flow-rib", etc.) during the injection molding operation and may have an increased width or height (e.g., thickness) to facilitate a more rapid distribution of plastic material and allow for improved controllability of the shape (e.g., shrinkage, sinkage, warping, distortion, etc.) of the top portion during and after the molding operation. According to other various alternative and exemplary embodiments, each lateral rib may be a different height than the ribs 71 (e.g., may be shorter than, the same height as, or be longer than ribs 71) or other lateral ribs. According to other various alternative and exemplary embodiments, each lateral rib may have the same thickness or a different thickness than the ribs 71.

According to one exemplary embodiment, the top portion and the body portion may be formed in separate molds and then joined to form a closure by coupling the engaging structure with the receiving structure. According to various exemplary and alternative embodiments, the engaging structure and the receiving structure provided in the end wall may comprise any number of projection/aperture pairs. According to other various exemplary and alternative embodiments, the projections may include any suitable structure (e.g., snap fit, friction fit, barb, flange, clip, radial extensions, etc.) for retaining the top portion in a coupled relationship with the body portion. According to still other various alternative and exemplary embodiments, the spacing between the components of the engaging structure and the receiving structure (e.g., the projections and the corresponding apertures) may be configured in one of a variety of different ways. For example, the projection/aperture pairs may be equally spaced across the closure, the space between the two innermost projection/aperture pairs may be greater than the space between the innermost projection/aperture pairs and the outermost projection/aperture pairs, the spacing between the projection/aperture pairs on one side of the closure may be different than that of the projection/aperture pairs on the other side of the closure to prevent top portion 20 from being coupled to body portion 100 in the wrong orientation, or the projection/aperture pairs may be spaced to accommodate a gate or other molding considerations.

Figure 4:
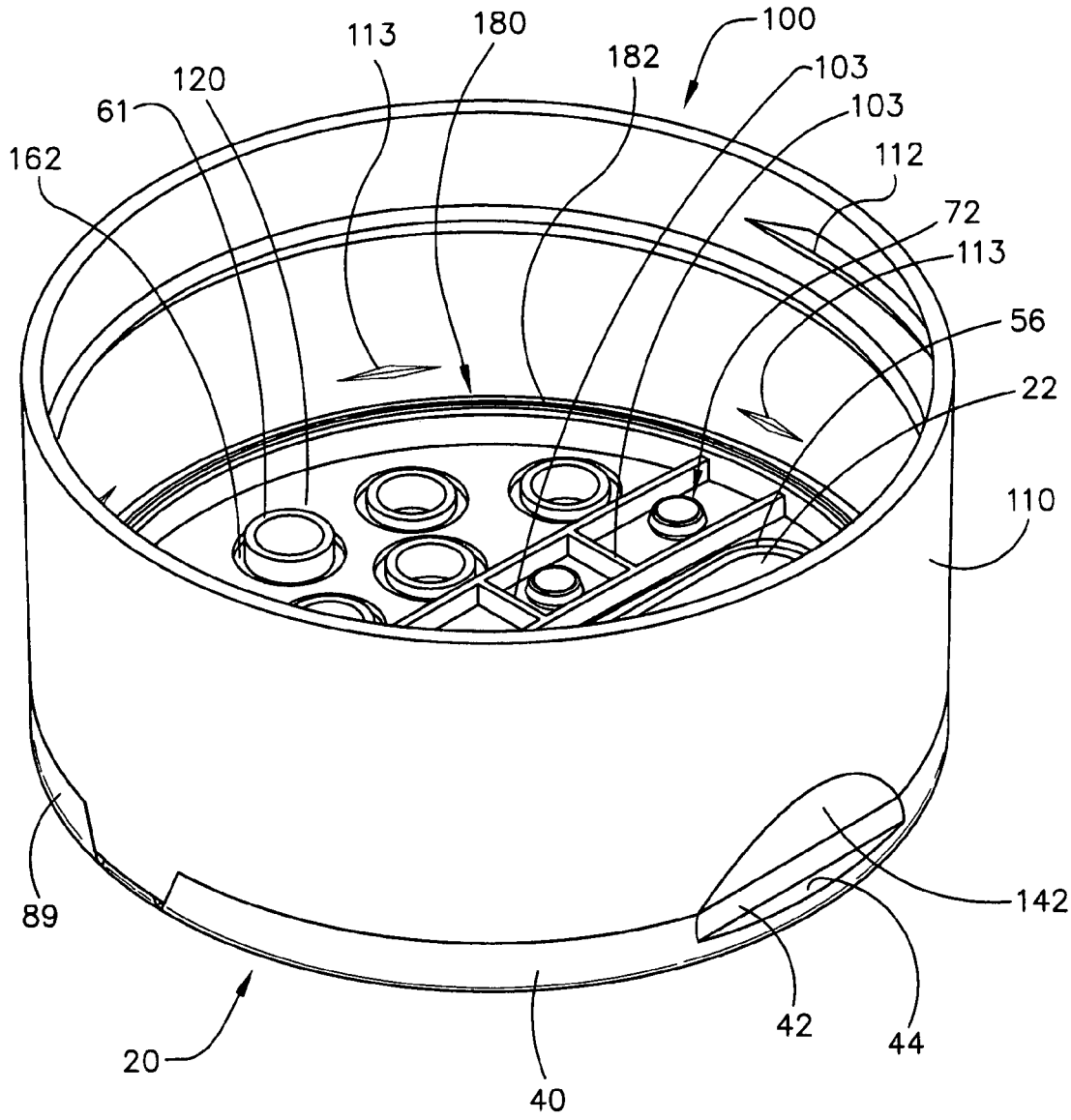
FIG. 4 is a schematic representation of a bottom perspective view of a spoon side of a closure for a container according to the embodiment of FIG. 1.
Figure 5:
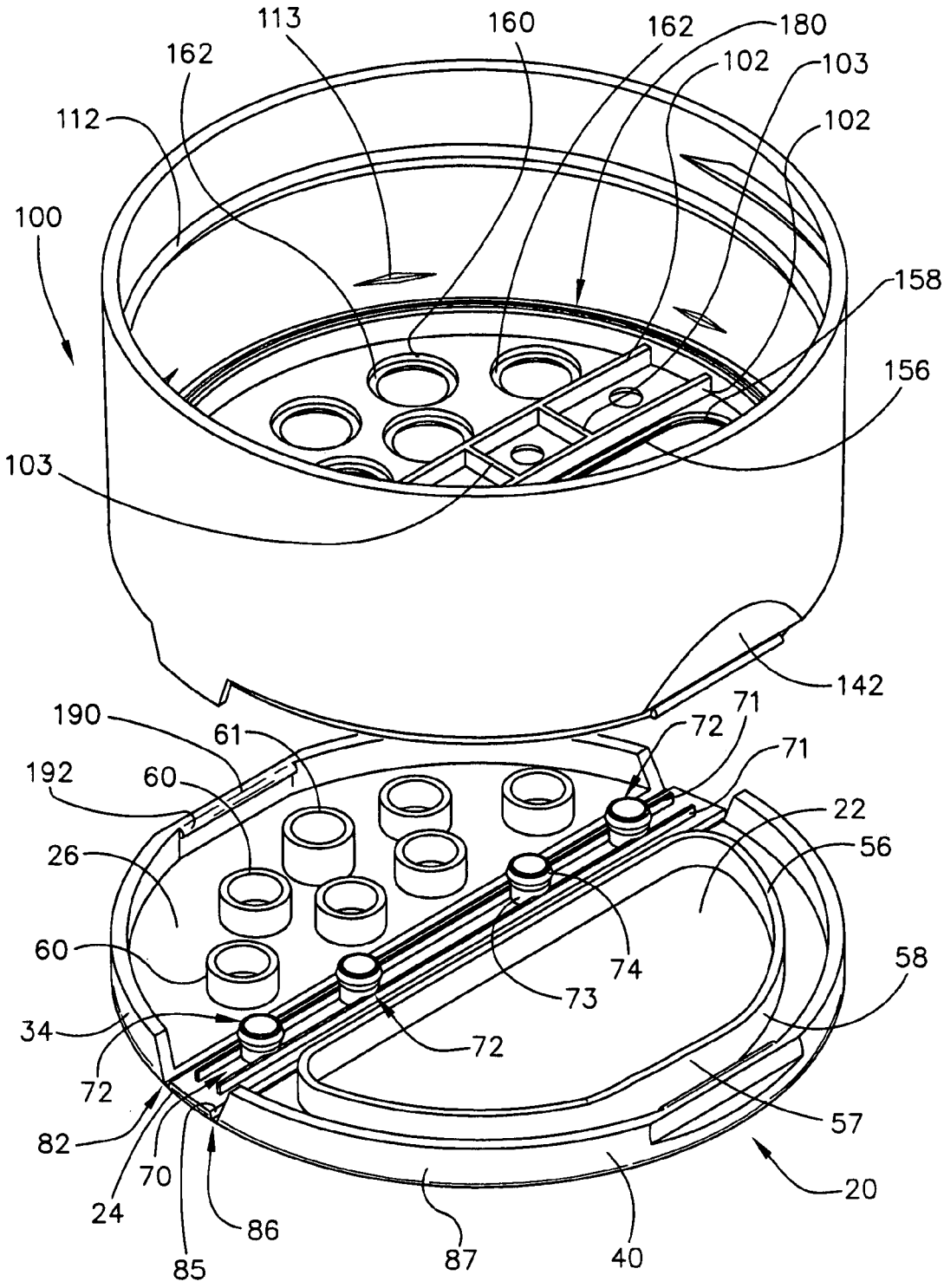
FIG. 5 is a schematic representation of a bottom exploded perspective view of a spoon side of a closure for a container having a body portion and a top portion according to the embodiment of FIG. 1.
Figure 6D:
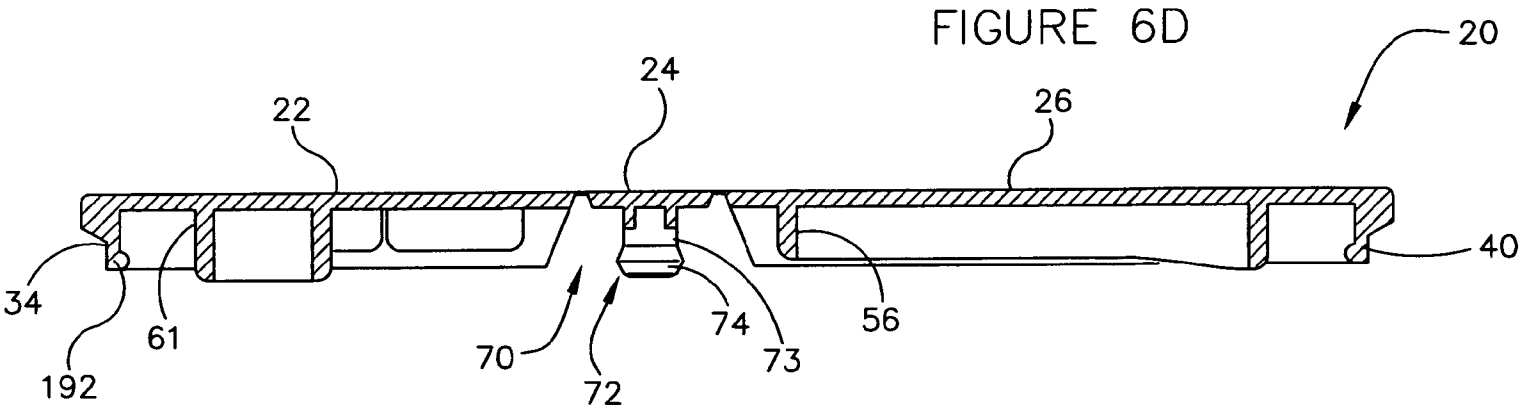
FIG. 6D is a schematic representation of a cross-sectional view of a top portion of a closure for a container taken along line 6D-6D of FIG. 6A.

Referring to FIGS. 4 and 5, a spoon flap closure system (e.g., inner closure system) is shown according to an exemplary embodiment. Spoon flap 22 comprises a projection 56 (e.g., clean-out ring, etc.) extending perpendicularly downward from an underside of spoon flap 22 and having an outline corresponding to spoon opening 156 (e.g., having a rounded outer edge 58). According to the illustrated embodiment, projection 56 has a rectangular cross-section and is positioned to engage (e.g., by friction) all, or a portion, of spoon opening 156 when spoon flap 22 is moved to a closed position. According to an alternative embodiment, the lower, outside edge (or a portion of the edge) of the projection may be relieved (e.g., radiused, angled, sloped, chamfered, beveled, etc.) to facilitate entry of the projection in the opening. The extension of projection 56 into spoon opening 156 tends to reduce the likelihood of "sifting" or other leakage of material in the container out from beneath spoon flap 22 when spoon flap 22 is in the closed position. According to one exemplary embodiment, the length of projection 56 is sufficient to allow the end of projection 56 to at least extend into spoon opening 156. According to various alternative and exemplary embodiments, the length of the projection may be sufficient to allow the projection to extend completely through the spoon opening or only a portion of the way through the spoon opening. According to one exemplary embodiment illustrated in FIGS. 5, 6D, and 8, projection 56 comprises a central outer portion 57 that is longer than the rest of projection 56. The added length of projection 56 at central outer portion 57 is intended to allow central outer portion 57 to engage the corresponding spoon opening 156 prior to the engagement of the rest of projection 56 when spoon flap 22 is being moved into the closed position. As a result, the angle of projection 56 (with respect to the central axis of side wall 110) as central outer portion 57 comes into contact with the corresponding spoon opening 156 when spoon flap 22 is being closed is greater than the angle of the rest of projection 56 when the rest of projection 56 comes into contact with spoon opening 156. The greater angle of contact is intended to create a greater degree of friction with the corresponding spoon opening 156. Adjusting the length of the central outer portion 57 is intended to alter the amount of force required to close (and open) spoon flap 22.

According to another exemplary embodiment illustrated in FIG. 10, spoon flap 22 may comprise a projection 56*a* that is similar to projection 56, except that the height of projection 56*a* gradually increases as it extends away from hinge 86. The maximum height of projection 56*a* occurs at a central outer portion 57*a*. According to various exemplary and alternative embodiments, the lowest height of the projection is between approximately 35 and 85 percent of the greatest height. According to other various exemplary and alternative embodiments, the lowest height is between approximately 50 and 75 percent of the greatest height. According to other various exemplary and alternative embodiments, the lowest height may be any percentage of the greatest height (e.g., less than 35 percent or more than 85 percent), including 0 percent of the greatest height. According to other various alternative and exemplary embodiments, the maximum and minimum heights of the projection may vary depending on the circumstances.

Referring still to FIGS. 4 and 5, a shaker flap closure system (e.g., inner closure system) is shown according to an exemplary embodiment. Shaker flap 26 has a plurality of projections 60 (e.g., clean-out rings, etc.) extending perpendicularly downward from an underside of shaker flap 26, corresponding to shaker openings 160. According to the illustrated embodiment, projections 60 have a rectangular cross-section and are positioned to frictionally engage the corresponding shaker opening 160 when shaker flap 26 is moved to a closed position. According to an alternative embodiment, the lower, outside edge (or a portion of the edge) of one or more of the projections may be relieved (e.g., radiused, angled, sloped, chamfered, beveled, etc.) to facilitate entry of the projection in the openings. The extension of projections 60 into shaker openings 160 tends to reduce the likelihood of "sifting" or other leakage of material in the receptacle out from beneath shaker flap 26 when shaker flap 26 is in the closed position. According to one exemplary embodiment, the length of each projection 60 is sufficient to allow the end of each projection 60 to at least extend into the corresponding shaker opening 160. According to various alternative and exemplary embodiments, the length of each projection may be sufficient to allow the projection to extend completely through the corresponding shaker opening or only a portion of the way through the corresponding shaker opening. According to another exemplary embodiment, at least one of the projections, shown as projection 61, is longer than the other projections (or, alternatively, includes a portion that extends beyond the length of the other projections 60). The added length of projection 61 is intended to allow projection 61 to engage the corresponding shaker opening 160 prior to the engagement of other shaker openings 160 by the other projections 60 when shaker flap 26 is being moved into the closed position. As a result, the angle of projection 61 (with respect to the central axis of side wall 110) as projection 61 comes into contact with the corresponding shaker opening 160 when shaker flap 26 is being closed is greater than the angle of projections 60 when projections 60 come into contact with the corresponding shaker openings 160. The greater angle of contact is intended to create a greater degree of friction with the corresponding shaker opening 160. By adjusting the length of the projection and/or the number of projections having such an adjusted length, the amount of force required to fully close (and open) shaker flap 26 can be adjusted or modified as desired.

According to various alternative and exemplary embodiments, the projections (or a portion of the projections) on the underside of the spoon flap and shaker flap may extend at an angle other than approximately 90 degrees from the underside of the flaps, and/or may include one or more perpendicular stiffening ribs or T-guides (e.g., such as those shown in U.S. Pat. No. 6,691,901 titled Closure for a Container issued on Feb. 17, 2004 and incorporated by reference herein) that are configured to engage the edge of the spoon or shaker openings and guide the projections into the openings with a wedging interaction. According to various alternative embodiments, the projections may extend only partially around the perimeter of the spoon and shaker openings. According to other alternative embodiments, the projections may be replaced with recesses that are formed into the top side of the spoon flap and shaker flap, that extend downward from the bottom side of the spoon flap and shaker flap, and that are configured to extend into and/or engage the spoon and shaker openings. According to other alternative embodiments, the projections may have a rectangular cross-section with a relieved (e.g., chamfered, tapered, beveled, sloping, etc.) lower outer edge and the projections may have a cross-section that is one of a variety of other shapes (e.g., football-shaped, trapezoidal, triangular, etc.). According to other alternative embodiments, the projections may have different lengths. According to other various alternative and exemplary embodiments, one or more of the projections may include radially outwardly extending projections (e.g., barbs, fingers, etc.) that are configured to engage the under side of end wall 120 to retain the flap in a closed position.

Referring now to FIGS. 1, 3, 5, 6B, 6D, 7D, and 8, a second (e.g., outer) closure system for each of spoon flap 22 and shaker flap 26 is shown according to an exemplary embodiment. Only the second closure system for the shaker flap is described below, as the second closure system for the spoon flap is similarly configured. The second closure system for the shaker flap comprises cooperating elements shown as a dimple 188 and an extension 192. Dimple 188 (e.g., recess, receptacle, cutout, channel, groove, furrow, etc.) is located near the bottom of a closure region of recess 114 that comprises a straight segment 186 that corresponds to indentation 136 in side wall 110. Extension 192 (e.g., rib, ridge, bump, projection, etc.) is located on a straight segment 190 of downwardly extending skirt 34 that corresponds to indentation 36 on shaker flap 26 and to straight segment 186 of recess 114. Extension 192 projects inwardly (e.g., toward the center of the top portion) from the straight segment 190 of skirt 34 and has a shape that is configured to cooperate with dimple 188. Extension 192 is configured to slide over or around the top of the closure region of recess 114 in a progressive friction-type manner and to engage dimple 188 when flap 26 reaches the closed position. According to an alternative embodiment, the closure region may be provided on a curved segment of the side wall along a curved portion of the face of the recess. According to other alternative embodiments, the closure system may include a plurality of individual extension/dimple pairs located about the outer edge of the end wall. According to other alternative embodiments, the location of the dimple and the extension may be reversed so that the dimple is located on the flap and the extension is located in the recess of the side wall. According to another alternative embodiment, the dimple located near the bottom of the recess may be replaced by a projection or extension near the top of the recess, and the extension located near the bottom of the skirt may be replaced with a recess or dimple near the top of the skirt.

According to various exemplary and alternative embodiments, the inner closure system (e.g., the shaker flap closure system and/or the spoon flap closure system) provide structure that tends to maintain the flaps in a closed position after the flaps are moved to a closed position and to minimize the tendency for material in the container to "sift" or otherwise leak out from the openings when the flaps are closed. According to various alternative embodiments, the outer closure system may provide structure that tends to "supplement" or otherwise assist the inner closure system and help retain the flaps in a closed position when the closure is subject to distortion (e.g., during container filling and capping operations in which the closure may be subjected to varying degrees of torque or other forces during installation of the closures on the receptacles, etc.). According to other alternative embodiments, the inner closure system or the outer closure system may provide the only structure that tends to maintain the flaps in a closed position or the closure may utilize one closure system for the shaker flap and the other closure system for the spoon flap.

Referring to FIGS. 4, 5, 7B, 7D, 7E, and 8, a sealing structure for a closure for a container is shown according to one exemplary embodiment. Sealing structure 180 (e.g., ring, sealing ring, stepped sealing ring, etc.) is configured with a plurality of sealing surfaces 182*a*, 182*b*, and 182*c* (e.g., as shown in U.S. Pat. No. 6,460,718 which is hereby incorporated by reference herein). According to one exemplary embodiment, sealing structure 180 extends from the lower surface of end wall 120 and is spaced apart from the inner circumference of side wall 110. Sealing surfaces 182*a*, 182*b*, and 182*c* are arranged in a "step-wise" pattern of coaxial surfaces such that the distance from end wall 120 increases as the diameter of the sealing surface decreases. According to various alternative and exemplary embodiments, the width of the sealing surfaces in the radial direction may be approximately equal to the thickness of the portion of the receptacle that will contact the sealing surfaces (e.g., the rim or mouth of the receptacle), but the width of the sealing surfaces may be greater or less than the thickness of the receptacle rim. Between each of sealing surfaces 182*a*, 182*b*, and 182*c* is a wall or surface that is perpendicular to the sealing surfaces 182*a*, 182*b*, and 182*c*. Wall 184*a* extends between sealing surfaces 182*a* and 182*b* from the outer periphery of sealing surface 182*a* to the inner periphery of sealing surface 182*b*. Similarly, wall 184*b* extends between sealing surfaces 182*b* and 182*c* from the outer periphery of sealing surface 182*b* to the inner periphery of sealing surface 182*c*. Such step-wise sealing surfaces 182*a*, 182*b*, and 182*c* are intended to urge a container mouth that has an out-of-round condition (e.g., oval, etc.) into a generally round condition for sealing against one of the plurality of sealing surfaces 182*a*, 182*b*, and 182*c*. Such step-wise sealing surfaces 182*a*, 182*b*, and 182*c* may also accommodate variations in the diameters of the mouths of receptacles (e.g., due to variations in tolerances, different container manufacturers or equipment, etc.). According to various alternative embodiments, the sealing surfaces may be configured so that the distance from the end wall may increase as the diameter of the sealing surfaces increases. According to other alternative embodiments, the sealing surfaces may be flat and parallel to the end wall, or they may have a convex or concave curvature, or they may have any combination of these or other suitable configurations and may be provided at any angle with respect to the end wall. According to other alternative embodiments, the transition from a wall to a sealing surface may be gradual (e.g., radiused, beveled, tapered, etc.) or it may be a substantially "sharp" corner. According to other alternative embodiments, the walls may be oriented at any angle with respect to the sealing surfaces. According to other various alternative and exemplary embodiments, the sealing structure may include one, two, four, or any number of sealing surfaces.

According to another alternative embodiment, the sealing structure may comprise a single downwardly extending projection (e.g., sealing ring, ridge, rim, etc.—not shown) having a shape and location that corresponds with a mouth of a receptacle such that the sealing ring is positioned to abut the mouth when the closure and receptacle are coupled together. According to various alternative and exemplary embodiments, the sealing ring may have a circular outline that is coaxial with the side wall, may extend from an interior underside of the recess in the upper perimeter of the side wall, and/or may have a lower edge with a semicircular cross-sectional shape configured to compress a conventional sealing sheet (e.g., liner, etc.) between the sealing ring and the mouth of a receptacle to create a seal. According to other alternative embodiments, the sealing ring may have any suitable cross-sectional shape (e.g., flat, pointed, tapered, etc.) and a width sufficient to provide an effective seal against the mouth of the receptacle.

According to various alternative and exemplary embodiments, the sealing ring (such as a stepped sealing ring or a semi-circular sealing ring similar to those previously described) may comprise one or more vent portions 181 (e.g., gaps, notches, openings, etc.) spaced at one or more locations around the sealing ring. Vent portions 181 are intended to provide locations where the liner may not be directly compressed against the mouth, which are intended to provide a passage through which pressure can be relieved across the sealing ring. For certain types of commercially available liner materials, compression of the surface of the liner against the surface of the mouth of the receptacle is intended to result in adhesion or fusion of a surface of the liner to the mouth surface to provide the seal. Vent portions 181 provide locations where the sealing ring does not contact the liner such that compression of the liner against the mouth at these locations may not be sufficient to result in the degree of adherence or fusion of the liner to the mouth that would interfere with venting of the container. Further, the gap provided by each vent portion 181 may provide space for deflection of the liner material to provide a vent path or passageway. According to one exemplary embodiment, vent portions 181 may have a length of between approximately 0.50 and 0.10 inches and a depth of between approximately 0.30 and 0.025 inches. According to another exemplary embodiment, the vent portions may have a length of approximately 0.25 inches and a depth of approximately 0.10 inches. According to other exemplary and alternative embodiments, the vent portions may have lower corners that are relieved (e.g., angled, sloped, chamfered, etc.) to minimize the potential for sharp edges that may contact the surface of the liner (e.g., edges that may otherwise catch, tear, puncture, wrinkle or otherwise damage a foil or other material on the surface of the liner). According to other various alternative and exemplary embodiments, the vent portions may be any suitable size and shape.

Referring to FIGS. 4, 5, 7D, 7E, and 8, projections for a closure for a container are shown according to an exemplary embodiment. Projections 113 extend inwardly and intermittently from the interior side of side wall 110 around the inner circumference of side wall 110. Projections 113 are located on side wall 110 a sufficient distance from the underside of end wall 120 to allow projections 113 to cooperate with the lowest surface of the sealing structure to permit a sealing sheet (e.g., liner, etc.) to be placed and retained between projections 113 and the sealing structure (such as during assembly or manufacturing of the closure). According to various exemplary and alternative embodiments, the projections may vary in number, size, shape, and location. According to other alternative embodiments, the projections may be one continuous projection that extends around the entire inner circumference of the side wall.

Referring to FIGS. 9C and 10, protrusions (e.g., projections, extensions, extraction rings, members, rings, etc.) for a closure for a container are shown according to an exemplary embodiment. Protrusions 115 and 116 are projections that extend radially inward from a vertical surface of body portion 100 (e.g., a surface parallel to the axis of side wall 110). Protrusion 115 is provided on a vertical wall 185, which is defined by the inside surface of sealing structure 180, and protrusion 116 is provided on the inside surface of side wall 110 at a location between threads 112 and the end of side wall 110 that is opposite top portion 20. Each of protrusions 115 and 116 has a semi-circular cross-section. According to one exemplary embodiment, each of protrusions 115 and 116 has a width (the distance the protrusion extends along the vertical surface of body portion 100) between approximately 0.100 and 0.005 inches and a height (the distance the protrusion extends away from side wall 110) between approximately 0.035 and 0.005 inches. According to another exemplary embodiment, each of protrusions 115 and 116 has a width between approximately 0.400 and 0.015 inches and a height between approximately 0.020 and 0.005 inches. According to another exemplary embodiment, each of protrusions 115 and 116 has a width of approximately 0.025 inches and a height of approximately 0.010 inches. According to other various exemplary and alternative embodiments, the protrusions may have any height (e.g., such as a height less than that of threads 112) and any width (e.g., such as a width less than that of threads 112). According to other various exemplary and alternative embodiments, each of protrusions 115 and 116 is located at a position within body portion 100 such that a cylindrical gage having a diameter slightly less than that of the vertical surface on which the protrusion 115 or 116 is provided could be inserted into the bottom of closure 10 (e.g., the end of side wall 110 that is opposite top portion 20) until it contacted protrusion 115 or 116. Protrusions 115 and 116 are intended to facilitate a quicker molding operation by more quickly providing a relatively solid structure the extraction portion of the mold can grip against as it extracts body portion 100. The quicker solidification of protrusions 115 and 116 is also intended to reduce any ovality in side wall 110 that would otherwise result in the absence of such protrusions.

According to various exemplary and alternative embodiments, each protrusion may have any one of a variety of different cross-sectional shapes and may have a variety of different widths and heights. For example, each protrusion may have a cross-sectional shape that is rectangular, triangular, frustoconical, trapezoidal, oval, or any other suitable shape. According to other various alternative and exemplary embodiments, the closure may include one, two, three, four, or more than four protrusions, and each of the protrusions may extend continuously or intermittently around the closure. According to other various alternative and exemplary embodiments, each protrusion may maintain the same position along the vertical axis of side wall 110 as it extends around the inside of the closure, or the protrusion may change its position as it extends around the closure (e.g., in a manner similar to a thread where the two ends of the protrusion to do not meet or in a manner such that the plane of the protrusion is angled slightly within the closure so that one side of the protrusion is at a different position relative to the longitudinal axis of side wall 110 than the opposite side of the protrusion). According to other alternative and exemplary embodiments, the height of each protrusion may remain the same as it extends around the body portion of the closure, or it may vary. According to still other alternative and exemplary embodiments, each protrusion may extend around the inside of the closure in a non-linear fashion (e.g., zigzag, sine wave, etc.) or may be provided intermittently, with different portions of the protrusions being provided at different locations along the longitudinal axis of side wall 110 than other portions of the same protrusions. According to still other alternative and exemplary embodiments, the protrusions may be provided at different positions within body portion 100. For example, vertical wall 185 may include two substantially parallel protrusions, one or more protrusions may be provided on one or more of ribs 102, or a protrusion may be provided at other areas of the body portion.

Figure 7E:
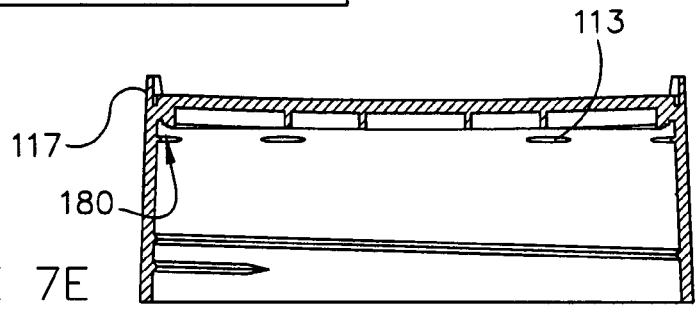
FIG. 7E is a schematic representation of a cross-sectional view of a body portion of a closure for a container taken along line 7E-7E of FIG. 7A.

According to various exemplary and alternative embodiments, various structures may be provided that are configured to urge or bias the flaps into a closed position, or existing structures may be configured to achieve the same result (e.g., as shown in U.S. Pat. No. 6,464,113 which is hereby incorporated by reference herein). As illustrated in FIGS. 7D, 7E, and 8, such structure may comprise a central region of the end wall on the body portion that is formed with a "bowed" or concave surface. When the top portion is coupled to the body portion and one or both of the flaps are moved to an open position, the interior edges of the flaps (proximate the hinge coupling each flap to the central portion of the top portion) tend to deflect the concave surface upward. The concave surface acts as a "flat spring" which has a tendency to return to its original position and to bias the flaps toward the closed position. According to an alternative embodiment, the central region of the top portion may be formed with a concave surface to act as a "flat spring" for biasing the flaps toward the closed position. According to other alternative embodiments, the central region of the end wall of the body portion and/or the central region of the top portion may be formed with a convex surface or other non-flat surface configuration to act as a "flat spring" for biasing the flaps toward the closed position.

Referring now to FIGS. 9A through 9C, various pairs of cooperating projections (e.g., rings, raised rings, lips, crowns, etc.) for a closure for a container are shown according to an exemplary embodiment. Each projection 200 (e.g., upper projection) is a raised region that surrounds a projection 60 and that extends downward from shaker flap 26. Each projection 202 (e.g., lower projection) is a similar raised region that extends upward from end wall 120 and that surrounds an aperture 160. Similarly, projection 204 is a raised region that surrounds projection 56 and that extends downward from spoon flap 22. Projection 206 is a similar raised region that extends upward from end wall 120 and that surrounds aperture 156. Due to the similarity of projections 200 and 202 and projections 204 and 206, only projections 200 and 202 will be described. According to one exemplary embodiment, upper projection 200 and lower projection 202 have the same general shape and are configured to contact or abut (e.g., an end 208 of upper projection 200 is configured to contact an end 210 of lower projection 202) against one another one when shaker flap 26 is moved into the closed position. The combined length of upper projection 200 and lower projection 202 is approximately equal to the total distance between the bottom of shaker flap 26 and the top of end wall 120 when shaker flap 26 is closed. The contact between upper projection 200 and lower projection 202 forms a partial seal that is intended to reduce the likelihood that any of the receptacle contents will be able to escape beyond upper projection 200 and lower projection 202. Projection 202, which extends above the surface of end wall 120, also serves to provide a sort of dike or moisture guard around aperture 160 that hampers the ability of any moisture or liquid that may be on end wall 120 to pass through aperture 160 and contaminate the contents of the receptacle.

According to various alternative embodiments, the diameter of the upper projection may be slightly larger or slightly smaller than the lower projection so that when the shaker flap is closed, the upper projection and lower projection overlap (e.g., the upper projection fits either around the outside of the lower projection or within the inside of the lower projection). In this configuration, each of the upper projection and the lower projection may have a length that is approximately equal to the distance between the bottom of the shaker flap and the top of the end wall when the shaker flap is closed or a length that is sufficient to allow the upper projection and the lower projection to overlap. According to other alternative embodiments, a pair of concentric or parallel raised rings or projections having a gap between them may surround each aperture in the end wall and extend upward from the end wall. The gap may be configured to receive one of the projections 60 or 56 (e.g., cleanout rings) or another projection that may be provided around projections 60 or 56 (e.g., a projection similar to projection 200) when the flap is closed. According to other alternative embodiments, a pair of concentric or parallel raised rings or projections having a gap between them may be provided on the bottom surface of the flap (one or both of which may be projections 60 or 56) and extend downward from the flap. The gap may be configured to receive a corresponding projection (e.g., a projection similar to projection 202) provided around an opening in the end wall when the flap is closed. According to various other alternative and exemplary embodiments, one of the projections may be offset (e.g., eccentric) from the other(s) or from one of the cleanout rings to provide an interference-type or friction-type coupling or latching interface for the flaps. According to other various alternative and exemplary embodiments, the raised projections may have any one of a variety of different shapes, sizes, lengths, and configurations. According to other various alternative and exemplary embodiments, the general shape of each raised region or projection may correspond to the aperture with which it is associated, or the shape may be substantially different than the shape of the aperture with which it is associated. According to other various alternative and exemplary embodiments, only a single projection may be provided one either the flap or the end wall that has a length equal to the distance between the bottom of the flap and the end wall.

According to various exemplary and alternative embodiments, a closure for a container is provided that comprises at least one opening for dispensing material from a receptacle and at least one flap for covering the opening or openings. The closure may be sized to couple to and cover receptacles of different sizes (e.g., a 33 millimeter receptacle, a 38 millimeter receptacle, a 43 millimeter receptacle, a 48 millimeter receptacle, a 53 millimeter receptacle, a 63 millimeter receptacle, a 70 millimeter receptacle, an 89 millimeter receptacle, a receptacle ranging from anywhere between approximately 20 millimeters and 140 millimeters, etc.). The closure comprises a body portion and a top portion that may be separately formed in a "direct-pull" type injection molding operation. The body portion and the top portion comprise coupling structure, such that the body portion and top portion may subsequently be coupled for use as a closure for a container. The top portion comprises a first closure system configured to engage the flap with the inside edge of the opening, and/or may comprise a second closure system configured to engage the flap with an outer edge of the end wall. The first and second closure systems may be used individually or in any suitable combination to provide a strategy for maintaining the flaps in a closed position under conditions that tend to result in opening of the flaps (e.g., distortion due to filling operations, etc.). The bottom portion may comprise a sealing ring or structure to provide a seal (e.g., air-tight or not) between the receptacle and the closure. The sealing ring may comprise at least one vent portion configured to allow sufficient venting of pressure to prevent damage to the container.

It is important to note that the construction and arrangement of the elements of the closure for a container provided in this specification are illustrative only. Although only a few exemplary and alternative embodiments of the present invention have been described in detail in this disclosure, those skilled in the art who review this disclosure will readily appreciate that many modifications are possible in these embodiments (such as variations in features such as orientation of flaps, skirts and corresponding recesses; variations in sizes, structures, shapes, dimensions and proportions of the flaps, recesses, projections, skirts, stiffeners and other elements; variations in the flap hinge arrangements, number of flaps, configuration and operation of flap closure structures and systems, arrangement and proportioning of spoon and shaker openings, use of materials, colors, combinations of shapes, etc.) without materially departing from the novel teachings and advantages of the invention. For example, the closure may be adapted and sized for use on any type of container or receptacle, or for use on containers or receptacles of different sizes, and/or the closure may be used for dispensing a variety of different materials or contents. The body portion and top portion may be adapted for use on a receptacle with a square, rectangular, or other shaped mouth or opening, or the shaker openings may be replaced with a single opening (e.g., a tear-drop, triangular, rectangular, circular, oval, or other shaped opening) and be configured to pour one or more of a variety of different materials, or the shaker openings may comprise a pattern having any number of openings arranged in one or more different shapes. According to other alternative embodiments, the closure may be adapted for coupling to a receptacle by a threaded interface or by a snap-on ring or other press-fit engagement structure. According to other alternative embodiments, the body portion and the top portion, or any combination thereof, may be integrally-formed as a single unitary body. It is readily apparent that each of the different embodiments and elements of the closure may be provided in a wide variety of shapes, sizes, thicknesses, combinations, etc. It is also readily apparent that the interfaces and structures for closing the flaps may be designed with any profile and configuration suitable for securing the flaps to the body portion. Accordingly, all such modifications are intended to be within the scope of the inventions as defined in any appended claims.

The order or sequence of any process or method steps may be varied or re-sequenced according to alternative embodiments. In any claims, any means-plus-function clause is intended to cover the structures described herein as performing the recited function and not only structural equivalents but also equivalent structures. Other substitutions, modifications, changes and omissions may be made in the design, operating configuration and arrangement of the exemplary and other alternative embodiments without departing from the spirit of the present inventions as expressed in any appended claims.

What is claimed is:

1. A closure for a container configured to fit over a mouth of a receptacle to form a container for particulate matter comprising:

a body portion having an open bottom formed of a skirt and an end wall defining an opening;

a top portion having a flap movable from a closed position where the opening is covered to an open position where the opening is at least partially uncovered to allow for matter to be dispensed;

a plurality of distinct and separate sealing rings within the skirt beneath the end wall comprising at least (1) a first ring with a sealing surface provided a first radial distance from the skirt and a first axial distance from the end wall and (2) a second ring with a sealing surface provided a second radial distance from the skirt and a second axial distance from the end wall;

wherein the first radial distance is different than the second radial distance and the first axial distance is different than the second axial distance;

so that the sealing surface of the first ring is configured to fit over a mouth of a receptacle having a first diameter and the planar sealing surface of the second ring is configured to fit over a mouth of a receptacle having a second diameter, wherein at least one of the plurality of sealing rings includes a vent portion.

2. The closure of claim 1 wherein the body portion comprises a body and the top portion comprises a cover and wherein the body and the cover are separate elements coupled to form the closure.

3. The closure of claim 1 wherein the body portion and the top portion are integrally-formed as a single unitary body.

4. The closure of claim 1 further comprising (3) a third ring with a sealing surface provided a third radial distance from the skirt and a third axial distance from the end wall.

5. The closure of claim 4 wherein the first axial distance is greater than the second axial distance and the second axial distance is greater than the third axial distance.

6. The closure of claim 5 wherein the first radial distance is less than the second radial distance and the second radial distance is less than the third radial distance.

7. The closure of claim 4 wherein none of the first ring, the second ring, and the third ring are affixed to the cylindrical skirt.

8. The closure of claim 1 wherein the sealing surface of the first ring is adjacent to the cylindrical skirt.

9. The closure of claim 1 wherein at least one of the first ring and the second ring is coupled to the end wall.

10. The closure of claim 1 wherein at least one of the first ring and the second ring is concentric with the cylindrical skirt.

11. The closure of claim 1 further comprising two parallel ribs extending across the bottom of the end wall.

12. A closure for a container configured to fit over a mouth of a receptacle to form a container for particulate matter comprising:

a body portion having an open bottom formed of a skirt and an end wall, the end wall defining a first opening and a second opening;

a top portion having (a) a first flap movable from a closed position where the first opening is covered to an open position where the first opening is at least partially uncovered to allow for matter to be dispensed, and (b) a second flap movable from a closed position where the second opening is covered to an open position where the second opening is at least partially uncovered to allow for matter to be dispensed;

a plurality of distinct and separate sealing rings within the cylindrical skirt beneath the end wall comprising at least (1) a first ring with a sealing surface provided a first radial distance from the skirt and a first axial distance from the end wall and (2) a second ring with a sealing surface provided a second radial distance from the skirt and a second axial distance from the end wall;

so that the sealing surface of the first ring is configured to fit over a mouth of a receptacle having a first diameter and the sealing surface of the second ring is configured to fit over a mouth of a receptacle having a second diameter, wherein at least one of the plurality of sealing rings includes a vent portion.

13. The closure of claim 12 wherein the body portion and the top portion are separate elements coupled together to form the closure.

14. The closure of claim 12 wherein the body portion and the top portion are integrally-formed as a single unitary body.

15. The closure of claim 12 wherein one of the first opening and the second opening is a spooning opening.

16. The closure of claim 12 wherein the first radial distance is different than the second radial distance and the first axial distance is different than the second axial distance.

17. The closure of claim 12 further comprising (3) a third ring with a sealing surface provided a third radial distance from the skirt and a third axial distance from the end wall.

18. The closure of claim 17 wherein the first axial distance is greater than the second axial distance and the second axial distance is greater than the third axial distance.

19. The closure of claim 18 wherein the first radial distance is less than the second radial distance and the second radial distance is less than the third radial distance.

* * * * *